US011505437B2

(12) United States Patent
Hoffmann et al.

(10) Patent No.: US 11,505,437 B2
(45) Date of Patent: Nov. 22, 2022

(54) CRANE HAVING A CRANE CONTROLLER

(71) Applicant: Palfinger AG, Bergheim bei Salzburg (AT)

(72) Inventors: Christoph Hoffmann, Fornach (AT); Thomas Deimer, Moosdorf (AT); Harald Vierlinger, Kuchl (AT)

(73) Assignee: PALFINGER AG, Salzburg (AT)

( * ) Notice: Subject to any disclaimer, the term of this patent is extended or adjusted under 35 U.S.C. 154(b) by 0 days.

(21) Appl. No.: 17/486,246

(22) Filed: Sep. 27, 2021

(65) Prior Publication Data

US 2022/0009749 A1 Jan. 13, 2022

Related U.S. Application Data

(63) Continuation of application No. PCT/AT2020/060127, filed on Mar. 24, 2020.

(30) Foreign Application Priority Data

Mar. 28, 2019 (AT) ..... GM 50057/2019

(51) Int. Cl.
*B66C 13/46* (2006.01)
*B66C 23/06* (2006.01)
(Continued)

(52) U.S. Cl.
CPC ..... *B66C 13/46* (2013.01); *B66C 13/56* (2013.01); *B66C 23/06* (2013.01); *B66C 23/68* (2013.01); *B66C 2700/0364* (2013.01)

(58) Field of Classification Search
CPC ..... B25J 5/00; B25J 5/005; B25J 5/007; B25J 5/06; B60P 1/54; B66C 13/46;
(Continued)

(56) References Cited

U.S. PATENT DOCUMENTS 5,769,251 A * 6/1998 Wada ..... B66C 23/54 212/292
6,424,885 B1 7/2002 Niemeyer et al.
(Continued)

FOREIGN PATENT DOCUMENTS

CN 1137783 12/1996
CN 102452618 5/2012
(Continued)

OTHER PUBLICATIONS

International Search Report dated Jul. 16, 2020 in International (PCT) Application No. PCT/AT2020/060127.
(Continued)

*Primary Examiner* — Sang K Kim
*Assistant Examiner* — Nathaniel L Adams
(74) *Attorney, Agent, or Firm* — Wenderoth, Lind & Ponack, L.L.P.

(57) ABSTRACT

A crane, in particular a loading crane, includes an arm system that has a plurality of arms. The crane also has a crane controller that is configured, in a coordinate control operating mode, to control the coordinates of the arm system. The crane controller has a user interface, and the user interface has at least one function which can be selected by a user and by way of which at least one of the degrees of freedom of the arm system can be restricted or is restricted in the coordinate control operating mode.

21 Claims, 32 Drawing Sheets

(51) Int. Cl.
*B66C 23/68* (2006.01)
*B66C 13/56* (2006.01)

(58) Field of Classification Search
CPC ..... B66C 13/56; B66C 23/06; B66C 23/68; B66C 2700/0364
See application file for complete search history.

(56) References Cited

U.S. PATENT DOCUMENTS 6,671,581 B2 12/2003 Niemeyer et al.
6,799,065 B1 9/2004 Niemeyer
6,862,509 B2 3/2005 Rau et al.
7,155,315 B2 12/2006 Niemeyer et al.
7,574,250 B2 8/2009 Niemeyer
7,725,214 B2 5/2010 Diolaiti
7,942,868 B2 5/2011 Cooper
7,967,813 B2 6/2011 Cooper et al.
8,057,385 B2 11/2011 Cooper et al.
8,062,211 B2 11/2011 Duval et al.
8,083,667 B2 12/2011 Cooper et al.
8,182,415 B2 5/2012 Larkin et al.
8,377,046 B2 2/2013 Cooper et al.
8,672,833 B2 3/2014 Cooper et al.
8,679,099 B2 3/2014 Cooper et al.
8,740,885 B2 6/2014 Larkin et al.
8,746,252 B2 6/2014 McGrogan et al.
8,784,435 B2 7/2014 Cooper et al.
8,839,967 B2 9/2014 Schneider et al.
8,852,208 B2 10/2014 Gomez et al.
8,945,148 B2 2/2015 Solomon et al.
8,986,196 B2 3/2015 Larkin et al.
9,060,678 B2 6/2015 Larkin et al.
9,096,033 B2 8/2015 Holop et al.
9,173,547 B2 11/2015 Duval et al.
9,215,967 B2 12/2015 Cooper et al.
9,301,807 B2 4/2016 Duval
9,320,416 B2 4/2016 Cooper et al.
9,345,387 B2 5/2016 Larkin
9,505,591 B2 11/2016 Morath et al.
9,510,734 B2 12/2016 Cooper et al.
9,549,663 B2 1/2017 Larkin
9,757,149 B2 9/2017 Cooper et al.
9,801,526 B2 10/2017 Larkin et al.
9,801,654 B2 10/2017 Gomez et al.
9,815,668 B2 11/2017 Morath et al.
9,949,620 B2 4/2018 Duval et al.
9,955,996 B2 5/2018 Solomon et al.
9,980,630 B2 5/2018 Larkin et al.
10,173,866 B2 1/2019 Deimer
10,398,520 B2 9/2019 Larkin et al.
10,448,813 B2 10/2019 Cooper et al.
10,456,166 B2 10/2019 Cooper et al.
10,537,358 B2 1/2020 McGrogan et al.
10,624,672 B2 4/2020 Gomez et al.
10,856,946 B2 12/2020 Solomon et al.
10,869,730 B2 12/2020 Holop et al.
10,918,449 B2 2/2021 Solomon et al.
10,961,086 B2 3/2021 Hangoebl
10,961,087 B2 3/2021 Hangoebl
11,198,391 B2 12/2021 Leitner et al.
11,304,769 B2 4/2022 Cooper et al.
11,376,086 B2 7/2022 McGrogan et al.
2003/0004610 A1 1/2003 Niemeyer et al.
2003/0114962 A1 6/2003 Niemeyer
2004/0039485 A1 2/2004 Niemeyer et al.
2004/0052627 A1 3/2004 Rau et al.
2004/0076503 A1* 4/2004 Rau ..... E04G 21/04 414/680
2006/0106493 A1 5/2006 Niemeyer et al.
2008/0064921 A1 3/2008 Larkin et al.
2008/0064927 A1 3/2008 Larkin et al.
2008/0064931 A1 3/2008 Schena et al.
2008/0065097 A1 3/2008 Duval et al.
2008/0065098 A1 3/2008 Larkin
2008/0065099 A1 3/2008 Cooper et al.
2008/0065100 A1 3/2008 Larkin
2008/0065101 A1 3/2008 Larkin
2008/0065102 A1 3/2008 Cooper
2008/0065103 A1 3/2008 Cooper et al.
2008/0065104 A1 3/2008 Larkin et al.
2008/0065105 A1 3/2008 Larkin et al.
2008/0065106 A1 3/2008 Larkin
2008/0065107 A1 3/2008 Larkin et al.
2008/0065108 A1 3/2008 Diolaiti
2008/0065109 A1 3/2008 Larkin
2008/0065110 A1 3/2008 Duval et al.
2008/0071288 A1 3/2008 Larkin et al.
2008/0071289 A1 3/2008 Cooper et al.
2008/0071290 A1 3/2008 Larkin et al.
2008/0071291 A1 3/2008 Duval et al.
2008/0217279 A1 9/2008 Gelies et al.
2010/0198232 A1 8/2010 Diolaiti
2011/0006025 A1 1/2011 Schneider et al.
2011/0238081 A1 9/2011 Cooper et al.
2011/0277775 A1 11/2011 Holop et al.
2011/0277776 A1 11/2011 McGrogan et al.
2011/0282351 A1 11/2011 Cooper et al.
2011/0282356 A1 11/2011 Solomon et al.
2011/0282357 A1 11/2011 Rogers et al.
2011/0282358 A1 11/2011 Gomez et al.
2011/0282359 A1 11/2011 Duval
2012/0022553 A1 1/2012 Cooper et al.
2012/0046669 A1 2/2012 Duval et al.
2012/0083654 A1 4/2012 Cooper et al.
2012/0095653 A1 4/2012 Morath et al.
2012/0203271 A1 8/2012 Larkin et al.
2012/0221011 A1 8/2012 Larkin et al.
2013/0053868 A1 2/2013 Cooper et al.
2013/0079794 A9 3/2013 Cooper et al.
2013/0144116 A1 6/2013 Cooper et al.
2014/0206936 A1 7/2014 Cooper et al.
2014/0263145 A1* 9/2014 Wimmer ..... B66C 23/707 212/299
2014/0296872 A1 10/2014 Cooper et al.
2014/0326254 A1 11/2014 McGrogan et al.
2015/0164597 A1 6/2015 McGrogan et al.
2015/0250546 A1 9/2015 Larkin et al.
2015/0305815 A1 10/2015 Holop et al.
2015/0329333 A1 11/2015 Fenker et al.
2016/0058512 A1 3/2016 Gomez et al.
2016/0066773 A1 3/2016 Cooper et al.
2017/0029252 A1 2/2017 Deimer
2017/0071628 A1 3/2017 Cooper et al.
2017/0073197 A1 3/2017 Morath et al.
2018/0014852 A1 1/2018 Gomez et al.
2018/0214176 A1 8/2018 Solomon et al.
2018/0229977 A1 8/2018 Hangoebl
2018/0229979 A1 8/2018 Hangoebl
2018/0242824 A1 8/2018 Larkin et al.
2018/0353204 A1 12/2018 Solomon et al.
2019/0233258 A1 8/2019 Reischauer et al.
2019/0365202 A1 12/2019 Larkin et al.
2019/0374293 A1 12/2019 Larkin et al.
2020/0000317 A1 1/2020 Cooper et al.
2020/0000490 A1 1/2020 McGrogan et al.
2020/0017027 A1 1/2020 Lehner et al.
2020/0246096 A1 8/2020 Gomez et al.
2020/0268465 A1 8/2020 McGrogan et al.
2021/0085411 A1 3/2021 Holop et al.
2021/0220066 A1 7/2021 Solomon et al.
2021/0346108 A1 11/2021 Cooper et al.
2021/0353377 A1 11/2021 Cooper et al.
2021/0361369 A1 11/2021 Cooper et al.
2022/0218429 A1 7/2022 Cooper et al.

FOREIGN PATENT DOCUMENTS

CN 106061885 10/2016
CN 108290722 7/2018
CN 108349714 7/2018
DE 100 60 077 6/2002
DE 20 2016 008 565 8/2018
EP 2 272 784 1/2011
JP 2020-15625 1/2020

(56) References Cited

FOREIGN PATENT DOCUMENTS

| | | | | |
|---|---|---|---|---|
| KR | 20100032536 | | 3/2010 | |
| WO | 2015/113084 | | 8/2015 | |
| WO | WO-2017063014 | A1 * | 4/2017 | ..... B66C 13/40 |
| WO | 2018/068071 | | 4/2018 | |

OTHER PUBLICATIONS

Search Report dated Mar. 25, 2022 in Chinese Patent Application No. 202080036281.X.

* cited by examiner

CRANE HAVING A CRANE CONTROLLER

BACKGROUND OF THE INVENTION

The invention relates to a crane and a vehicle having such a crane.

Generic cranes having a crane controller which is configured, in an operating mode, to carry out a coordinate control of the arm system are known in the state of the art.

During a conventional operation of a crane, in which the individual actuators of the arm system are individually actuated directly by a user or operator through control commands issued by him or her, the movement of the crane tip of the arm system results from the individual actuation movements controlled by the user. A movement of the crane tip of the arm system along approximately an ideal vertical path thus requires a complex issuing of individual control commands by the user.

During a coordinate control of the arm system, on the other hand, the individual actuators of the arm system are actuated by the crane controller such that the user actuates the behavior of the crane tip of the arm system instead of the individual actuators themselves. Embodiments of coordinate controls are known in which the crane is controlled by the user essentially with only two operating elements (e.g. joysticks), one for pivoting the crane column and one for carrying out a horizontal movement and a vertical movement of the crane tip.

Because of the high complexity of some arm systems, which can comprise for example a crane column, a main arm (also called lifting arm) arranged pivotable on the crane column and an articulated arm, arranged pivotable on the main arm, with an extension arm mounted displaceable therein, the arm system can have more degrees of freedom than are necessary at the least for the positioning and orientation of the crane tip in space. Thus, the crane column of a generic crane is mounted pivotable over a structurally predefined crane column pivoting range and has one degree of freedom due to its pivotable mounting. The main arm is mounted on the crane column pivotable over a structurally predefined main arm pivoting range and has one degree of freedom due to its pivotable mounting. The articulated arm is mounted on the main arm pivotable over a structurally predefined articulated arm pivoting range and has one degree of freedom due to its pivotable mounting. The at least one extension arm is mounted in the articulated arm displaceable over a structurally predefined pushing range and has one degree of freedom due to its displaceable mounting. The arm system of a generic crane therefore has four degrees of freedom. In the state of the art, such arm systems are known for example as redundant or overdetermined manipulators.

With each specification of a path which the crane tip is to follow during a coordinate control, an infinite number of joint trajectories—thus in turn paths which the joints of the arm system are to follow—can thereby be possible. The excess movability due to the overdetermination is often used to optimize, for example, the movement sequence of the arm system or to avoid obstacles.

During such a named control, after the specification of a desired path of the crane tip, thus after issue of a corresponding control command by the user (for example movement of the crane tip in Cartesian coordinates), a so-called reverse transformation or kinematic inversion is usually carried out by a processor or a processing unit of the crane controller, from which the control commands, suitable for the desired path, for actuating the actuators of the arm system result (for example movement of the arm system along the degrees of freedom of the joints). In order to achieve an unambiguous solution for such a reverse transformation for an overdetermined arm system, the reverse transformation for generating control commands for the arm system must be effected taking into account optimization criteria (such as for example so-called cost functions with weighting matrices) and optionally using approximations, and is associated with a large computing effort. During an actuation of the arm system effected in such a way, movements of the arm system of the crane that are not directly foreseeable for the operator can occur.

SUMMARY OF THE INVENTION

The object of the invention is to specify a crane with a crane controller which is configured, in an operating mode, to carry out a coordinate control of the arm system, as well as a vehicle with such a crane, in which the operator can influence the movement of the arm system in order to prevent unforeseen movements and in which the complexity of calculating the reverse transformation is reduced.

In a crane according to the invention, the crane controller has a user interface, and the user interface has at least one function that can be chosen by a user and through which at least one of the degrees of freedom is limitable or limited in the coordinate control operating mode.

Through the limitation of at least one of the degrees of freedom of the arm system, in the coordinate control operating mode unforeseeable movements of the arm system can be prevented and the complexity of calculating the reverse transformation can be greatly reduced.

The movements of the arm system can be more foreseeable for the user through the limitation of at least one of the degrees of freedom by the at least one function that can be chosen by a user. A user can thus, for example by selecting a corresponding function, limit and/or disable, in a targeted manner, degrees of freedom of the movement of the arm system which the user does not wish to be involved in the movement of the arm system in the coordinate control operating mode.

Because a user can select at least one function for limiting at least one of the degrees of freedom of the arm system, the movements of the arm system can be adapted in a targeted manner to the planned lifting process. The user can thus be given the possibility of interacting with the crane, whereby the user can influence the functioning of the crane.

In an embodiment of the invention, the user can thereby be given the possibility of selecting the arms of the arm system involved in the coordinate control. In a further development of this embodiment of the invention, a user can additionally be given the possibility of preferring or prioritizing different combinations of arms of the arm system that are involved in the coordinate control.

Because a user interface is provided, the selection of the at least one function can be easily made possible for the user.

According to a preferred embodiment, the arm system additionally has a second articulated arm, which is mounted on the extension arm pivotable over a structurally predefined second articulated arm pivoting range and has one degree of freedom due to its pivotable mounting, and which preferably comprises at least one second extension arm, which is mounted in the second articulated arm displaceable over a structurally predefined second extension arm pushing range and has one degree of freedom due to its displaceable mounting. The second articulated arm expands the space of the possible positioning of the crane tip and is often also referred to as a so-called "fly jib".

Preferably, the arm system additionally has at least one main arm extension arm, which is mounted in the main arm displaceable over a structurally predefined extension range and has one degree of freedom due to its displaceable mounting. Due to the at least one main arm extension arm, the main arm can be formed telescopic.

In a preferred embodiment, at least one additional device in the form of an implement and/or an arm extension, preferably an arm extension that is static and optionally can be arranged at a predefinable angle, is arranged on the arm system.

In principle, taking the geometric data of additional devices or attachments into account in the calculation is not a problem for the coordinate control. For this, the coordinate control need only be supplied with information about an additional device attached to the arm system (e.g. information about the function range, dimension data, angular positions), with the result that this information can be incorporated in the calculation.

Therefore, information, preferably information about the function range and/or dimension data and/or angular positions, for the at least one additional device can be transferred to the crane controller via the user interface, and the information can be selected from a database stored in a memory of the crane controller and/or can be input via the user interface, preferably via a setup screen. Thus, for example, information already stored in the crane controller about an additional device can be selected via a menu or information can be input by the user via a setup screen. The setup state of the crane can thereby be configured correctly and it can be made possible for a coordinate control of the tip of the additional device to be carried out in the coordinate control operating mode. In order to ensure the setup state of the crane, a safety query can be provided. Thus, it can be provided that the user has to confirm the setup state of the crane via the user interface by selecting a corresponding function of the user interface.

Preferably, the crane controller is configured to carry out a coordinate control of the crane tip or of a predefined or predefinable point of the arm system or a predefined or predefinable point supported by the arm system. In the coordinate control operating mode, a coordinate control of the crane tip is carried out in most cases. Instead of the crane tip, however, any other point of the arm system or a point supported by the arm system can also be used, for which a coordinate control is carried out. Thus, a cable winch could be arranged on the arm system and a coordinate control could be carried out in relation to the attachment point of the cable winch on the arm system or in relation to the load hook on the cable end of the cable winch. It can thereby be provided, during a cable winch operation, that the coordinate control is no longer based on the crane tip itself, but directly controls the position of the load at the cable end. The switch from a coordinate control of the crane tip to a coordinate control of a predefined or predefinable point of the arm system or a predefined or predefinable point supported by the arm system can be detected by the crane controller and proposed to the operator, who can or must confirm this switch. This switch can be activated by the operator by selecting a corresponding function of the user interface.

As the kinematics of a generic crane, which can be a loading crane, are overdetermined for the coordinate control owing to the degrees of freedom of the arm system that are present, restrictions and/or specifications must be made for an unambiguous solution of the reverse transformation, in order to resolve or reduce this overdetermination. The limitation of the degrees of freedom of the arm system represents a suitable restriction.

In a particularly preferred embodiment, at least one degree of freedom of the arm system is limitable or limited by the at least one function that can be chosen by the user, in order to nullify or reduce an overdetermination of the arm system. Through a nullification of the overdetermination or redundancy of the arm system, the complexity of calculating the reverse transformation, from which the control commands, suitable for the desired path, for actuating the actuators of the arm system result, can be greatly reduced.

The degree of freedom of the rotatable crane column is excluded from the quantity of limitable or limited degrees of freedom to retain the pivotability of the crane column. This makes sense in particular in embodiments of coordinate controls in which the crane is controlled by the user with two operating elements (e.g. joysticks), wherein one of the two operating elements is used to pivot the crane column and the other operating element is used to carry out a horizontal movement and a vertical movement of the crane tip.

Retaining the pivotability of the crane column can be desirable, for example, if this degree of freedom of the movement of the arm system is present in a non-redundant manner.

The fact that the degree of freedom of the rotatable crane column is excluded from the quantity of limitable or limited degrees of freedom to retain the pivotability of the crane column can be advantageous in particular in the case of supporting situations of the crane in which the axis of rotation of the pivotable crane column deviates from the vertical.

Preferably, through the at least one function that can be chosen by the user, one degree of freedom of the arm system is limitable or limited or all degrees of freedom of the arm system except for two degrees of freedom are limitable or limited. During a coordinate control of the arm system in which the coordinate control can be carried out by actuation of main arm, articulated arm and extension arm, the limitation of one degree of freedom is sufficient to nullify or reduce an overdetermination of the arm system, as precisely two degrees of freedom are left over after the limitation of one degree of freedom, in order to carry out a horizontal movement and a vertical movement of the arm system. If the arm system comprises additional arms (e.g. a second articulated arm), the limitation of all degrees of freedom of the arm system except for two degrees of freedom is sufficient to nullify or reduce an overdetermination of the arm system, as precisely two degrees of freedom are left over after such a limitation of the degrees of freedom, in order to carry out a horizontal movement and a vertical movement of the arm system. In other words, the coordinate-controlled movements of the arm system are thereby implemented with only two arms or crane sections or degrees of freedom, whereby these movements are unambiguously determined and easier for the user to understand. Moreover, unforeseeable movements of the arm system can be prevented by limiting one degree of freedom or the degrees of freedom of an undesired arm.

According to a particularly preferred embodiment, the crane controller is configured, in the coordinate control operating mode, to use an arm selection in the form of a subset of the arms of the arm system to carry out the coordinate control of the arm system. The crane controller has at least one operating profile, in which at least two arm selections are stored in a predefined or predefinable ranking from a higher prioritization to a lower prioritization or are determined continuously, and the crane controller is configured to use and actuate the arm selections stored in the at least one operating profile according to their prioritization for carrying out the coordinate control of the arm system. The at least one operating profile can be selected through the at least one function that can be chosen by the user. A continuous determination can be effected during operation depending on the current position of the arm system or the suitability of an arm selection for the lifting movement carried out or to be carried out.

Preferably, each of the at least two arm selections consists of two arms of the arm system.

One of the operating profiles can be, for example, a so-called default prioritization, which is always used when no other operating profile is selected specifically or in a targeted manner.

The following Table 1 shows an example of such a default prioritization for a crane with an arm system which, in addition to main arm, articulated arm and extension arm, comprises a second articulated arm and a second extension arm. The operating profile represented in the table comprises 10 arm selections with different prioritizations. In the table, the prioritization with the number 1 represents the highest prioritization and the prioritization with the number 10 represents the lowest prioritization.

In the following tables, the arms of the arm system are abbreviated as follows: HA corresponds to the main arm, KA corresponds to the articulated arm, SA corresponds to the extension arm (of the articulated arm), JKA corresponds to the second articulated arm, JSA corresponds to the second extension arm (of the second articulated arm).

TABLE 1

| Prioritization | Arm selection |
|---|---|
| 1 | KA + SA |
| 2 | HA + SA |
| 3 | HA + KA |
| 4 | JSA + JKA |
| 5 | HA + JSA |
| 6 | KA + JSA |
| 7 | SA + JKA |
| 8 | KA + JKA |
| 9 | HA + JKA |
| 10 | SA + JSA |

According to a preferred embodiment, the crane controller is configured to use an arm selection for the coordinate control depending on a predefinable and/or a predefined and/or a prevailing position of the arm system.

Preferably, the crane controller is configured in order that the use and actuation of an arm selection from the at least two arm selections is additionally effected depending on the ability of the coordinate control to be carried out with the respective arm selection.

Thus, for example, if the default prioritization represented by way of example in Table 1 is used, the arm selection with the prioritization 1 (articulated arm and extension arm) could be used for the coordinate control first depending on the position of the arm system and on the ability of the coordinate control to be carried out. If the movement desired by the user is not possible with this arm selection, the arm selection with the next prioritization down, thus prioritization 2 (main arm and extension arm), would be used for the coordinate control. This would continue along the prioritizations until an arm selection with which the movement desired by the user can be carried out is found.

Depending on the arms or crane sections present, different operating profiles can be stored. Thus, in the case of a crane with an arm system comprising main arm, articulated arm, extension arm, second articulated arm and second extension arm, for example, a first operating profile can be stored, the arm selections of which comprise only main arm and/or articulated arm and/or extension arm, and a second operating profile can be stored, the arm selections of which are subsets of all arms present.

Table 2 represented below shows by way of example a first operating profile and Table 3 represented below shows by way of example a second operating profile.

The first operating profile, represented in Table 2, comprises 3 arm selections with different prioritizations. In the table, the prioritization with the number 1 represents the highest prioritization and the prioritization with the number 3 represents the lowest prioritization. The second operating profile, represented in Table 3, comprises 10 arm selections with different prioritizations. In the table, the prioritization with the number 1 represents the highest prioritization and the prioritization with the number 10 represents the lowest prioritization.

TABLE 2

| Prioritization | Arm selection |
|---|---|
| 1 | HA + KA |
| 2 | KA + SA |
| 3 | HA + SA |

TABLE 3

| Prioritization | Arm selection |
|---|---|
| 1 | HA + KA |
| 2 | KA + SA |
| 3 | HA + SA |
| 4 | HA + JKA |
| 5 | HA + JSA |
| 6 | KA + JKA |
| 7 | KA + JSA |
| 8 | SA + JSA |
| 9 | SA + JKA |
| 10 | JKA + JSA |

With reference to the first operating profile according to Table 2, a possible use of this operating profile is explained below by way of example. If the movement of the arm system desired by the user is possible with the highest-priority arm selection, thus prioritization 1 (main arm and articulated arm), this arm selection is always used to carry out the coordinate control of the arm system. If one of the arms of the arm selection reaches the limit of travel or is otherwise blocked, the arm selection with the next prioritization down is used. Should the arm selection with the prioritization 1 become available again in the course of the movement of the arm system (i.e. the movement desired by the user were to be possible again with this arm selection), the process will still continue with the currently used arm selection, in order to avoid a constant changing of the arm selections used for carrying out the coordinate control. Not until a re-start of the movement (after a neutral position of the lever) or a switch of the arm selection again owing to a limit of travel or blocking is the arm selection with the prioritization 1 taken into consideration again. Thus, in the case of this use of the first operating profile according to Table 2, for example, the following sequence can result:

1. Start with the arm selection with the prioritization 1 (main arm and articulated arm), as all arm selections of the operating profile are possible and this arm selection has the highest prioritization.
2. Main arm reaches the limit of travel.
3. Switch to the next possible prioritization, e.g. arm selection with the prioritization 2 (articulated arm and extension arm).
4. Arm selection with the prioritization 1 (main arm and articulated arm) available again, the arm selection with the prioritization 2 (articulated arm and extension arm) remains active.
5. Extension arm reaches the limit of travel.
6. Switch to arm selection with the prioritization 1 (main arm and articulated arm) if possible, stop if not.

The ranking of the at least two arm selections of an operating profile is alterable. In particular, the ranking can be determined continuously.

Table 4 represented below shows by way of example a further operating profile. This comprises 3 arm selections with different prioritizations. In the table, the prioritization with the number 1 represents the highest prioritization and the prioritization with the number 3 represents the lowest prioritization.

TABLE 4

| Prioritization | Arm selection |
|---|---|
| 1 | KA + SA |
| 2 | HA + SA |
| 3 | HA + KA |

Supplementing the use of the operating profile shown in Table 4, in the example explained below for the degree of freedom of the pivoting movement of the main arm a target angle of 20° was set, for example by a corresponding function of the user interface for setting the target angle of the main arm having been selected.

The crane is moved in a coordinate-controlled manner using the arm selections of the operating profile according to Table 4 and, in the course of the movement of the arm system, the main arm departs from its target angle and is at an angular position of 50°. Subsequently, owing to a limit of travel or a re-start of the movement, a switch of the arm selection occurs. After that, the two arm selections which comprise the main arm (thus the arm selection with the prioritization 2 and the arm selection with the prioritization 3) are evaluated by the crane controller as to whether the target angle of the main arm can be arrived at again with the current user specification. Thereafter, the arm selection which moves the main arm back into its target angular position the quickest is temporarily put in first place (or obtains the prioritization with the number 1). When the target angle of the main arm is reached, the arm selection temporarily put in first place is put back to its original position according to Table 4 (or obtains its original prioritization again).

In a preferred embodiment, the limitation of the at least one degree of freedom is effected in that it is settable or set to a predefined or predefinable value and/or is restrictable or restricted to a predefinable or predefined partial range and/or restrictable or restricted in relation to its rate of change.

Therefore, at least one arm of the arm system can be blocked through the at least one function that can be chosen by the user. In other words, at least one arm of the arm system can thus be temporarily blocked, with the result that this at least one blocked arm no longer participates in the coordinate-controlled movement of the arm system, and instead remains in its blocked position. However, the fact that the at least one blocked arm no longer participates in the coordinate-controlled movement of the arm system is not intended to mean that it remains, for example, stationary in space, but rather that the degree or degrees of freedom of the at least one blocked arm are no longer used for moving the arm system.

For the crane, the user interface comprises at least one operating element (for example, a knob, a linear lever or an axis of a multi-axis joystick) of the crane controller and a selection of the function that can be chosen is effected through an actuation of the at least one operating element by a user.

In principle, the crane controller is configured, in a further operating mode, to carry out a free control of the arm system. This can correspond to a conventional operation of a crane in which the individual actuators of the arm system are individually actuated directly by a user through control commands issued by him or her.

In such a further operating mode, a free actuation of the arm system can be effected by at least one operating element of the crane controller. In each case, one operating element is provided for the input of control commands for moving in each case one arm of the arm system along one degree of freedom. Thus, in each case, one operating element (for example, a linear lever assigned to the movement or one axis of a multi-axis joystick) can be provided for the free actuation of the arm system for the respective movement of one arm of the arm system along its respective degree of freedom.

Through an actuation (for example by movement in a particular direction) of the at least one operating element by a user, while the crane controller is in the coordinate control operating mode, the degree of freedom of the arm system assigned to the operating element in the above-described further operating mode is limitable or limited. The assignment of the function of the at least one operating element in the further operating mode for the free actuation of the arm system can be used in the coordinate control operating mode for a selection of a limitation of the corresponding degree of freedom of the movement of the arm system.

Analogously thereto, a limitation can be nullified again by a corresponding actuation (for example, by a movement in the opposite direction) of the operating element.

Thus, for example, the main arm (or any other arm of the arm system) can be blocked, in order to simplify the movement sequence for the user. For the blocking as well as for the nullification of the blocking of an arm, an input device of the user interface can be used, such as for example a button of a menu-driven user interface or operating elements such as for instance a lever of a lever-operable user interface. In addition to the input devices for the coordinate control operating mode, a user interface of a crane controller for a crane often also has individual operating levers (for instance a joystick with for example two orthogonal axes or single-axis linear levers) for a free control of the arm system in a further operating mode. These operating levers, which are not used to control the arm system in the coordinate control operating mode, can be used for the blocking as well as for the nullification of the blocking of an arm. Thus, for example, the main arm can be blocked via the operating element not used in the coordinate control for the main arm movement (for example the main arm lever).

The user can position the main arm in a desired position and then fix the main arm angle. For this purpose, the user only has to deflect the operating element assigned to the main arm movement (for instance a joystick with, for example, two orthogonal axes or a single-axis linear lever) in one direction and can thus activate the movement block. All further coordinate-controlled movements of a crane with main arm, articulated arm and extension arm are then carried out only with articulated arm and extension arm. In addition, a visualization on a display of the crane controller can be effected, in which blocked arms or crane sections are correspondingly marked. If the operator actuates the operating element assigned to the main arm movement again (e.g. in the opposite direction), he or she can very conveniently nullify the blocking or fixing of the main arm again. Such a blocking or fixing can be effected in an analogous manner for every other arm or every degree of freedom of the movement of the arm system.

As an example, the main arm can be positioned high (e.g. 70°-80°) and then blocked. The coordinate-controlled crane movements are thus carried out only with an articulated arm and an extension arm, and a very large range of movement can thus be covered. In addition, the main arm can thus be prevented from colliding with structures on a carrier vehicle or a truck on which the crane is installed due to unforeseen movements.

Preferably, through a limitation of the at least one degree of freedom, the degree of freedom of the articulated arm is restrictable or restricted to a predefinable or predefined partial range, preferably to a predefinable or predefined quadrant, with the result that, in the coordinate control operating mode, the articulated arm is positionable or positioned in an overextended pivot position above an imaginary extension of the main arm.

An imaginary extension of the main arm (main arm line) and an imaginary line running perpendicularly thereto through the pivot bearing of the articulated arm on the main arm (pivot bearing line) form four regions or quadrants. Quadrant 1 denotes the region between the main arm line and the pivot bearing line above the main arm line and in the direction of the imaginary extension of the main arm. Quadrant 2 denotes the region between the main arm line and the pivot bearing line above the main arm line and in the direction of the main arm. Quadrant 3 denotes the region between the main arm line and the pivot bearing line underneath the main arm line and in the direction of the main arm. Quadrant 4 denotes the region between the main arm line and the pivot bearing line underneath the main arm line and in the direction of the imaginary extension of the main arm.

An absence of conventional coordinate controls is the lack of an unambiguous solution for the so-called overextension of the articulated arm, in which the articulated arm is to move from a pivot position underneath an imaginary extension of the main arm (quadrant 4) to a pivot position above the imaginary extension of the main arm (quadrant 1). In particular, there is a discontinuity in the calculation at the dead center (the articulated arm angle is 0°, i.e. the articulated arm is arranged in an exactly straight extension relative to the main arm).

One possibility would be to overextend the articulated arm with the aid of a manual override, by selecting a corresponding function of the user interface.

However, the crane controller, in the coordinate control operating mode, can provide an assistance function, through which, when approaching the dead center, the articulated arm is moved starting from quadrant 4 into quadrant 1 and the degree of freedom of the articulated arm is restricted to quadrant 1. As soon as the articulated arm is located in quadrant 1, it will move only in this quadrant, in order to keep the calculation unambiguous. The transition from an overextended pivot position of the articulated arm (pivot position above the imaginary extension of the main arm) to a pivot position underneath the imaginary extension of the main arm can be effected correspondingly in reverse. It can be provided that the assistance function can be selected through the at least one function that can be chosen by the user.

In an embodiment of the invention, the predefinable or predefined partial range is smaller than or equal to 2°, preferably smaller than or equal to 0.5°, or is smaller than or equal to 10 cm, preferably smaller than or equal to 2.5 cm, and/or the rate of change is smaller than or equal to 0.2° per second, preferably smaller than or equal to 0.05° per second, or is smaller than or equal to 2 cm per second, preferably smaller than or equal to 0.5 cm per second. A limitation of one of the degrees of freedom of the arm system can thus correspond to a greatly decelerated movement of a respective arm along a respective degree of freedom. During an actuation of the arm system in the coordinate control operating mode, an arm correspondingly limited in its movement or a correspondingly limited degree of freedom can be regarded by a user as substantially uninvolved in the movement of the arm system. From the user's point of view, substantially no unforeseeable movements thus result.

According to a preferred embodiment, the crane controller has a, preferably portable, control panel and the user interface is formed on the control panel. The control panel can have a display and operating elements in the form for instance of a knob, a linear lever and a push button. The operating elements can be used to navigate the menu-supported user interface, to select the function that can be chosen by a user or to issue control commands by a user.

By a portable control panel can be meant a standalone operating unit with which a user can move substantially freely in a certain periphery around a crane or a hydraulic lifting device. Of course, data and information can be exchanged between such a control panel and the crane or the hydraulic lifting device, for example via radio and/or cable-supported connections.

Preferably, the user interface is menu-driven and/or comprises at least one operating element of the crane controller. The menu-driven user interface can follow a hierarchical structure. It is conceivable that the menu items of the user interface can be graphically modelled and represented. A menu-driven user interface can make it possible for a user to select different functions, for example from a list of predefined or predefinable functions.

According to a preferred embodiment, the crane controller comprises a display. If the display of the crane controller is implemented as a touch display, then the user interface can be implemented directly via the touch display. For example, by touching a crane arm, represented on the display, of an arm system represented once, the corresponding degree of freedom can be limited. On the display, to visualize the limitation of the degree of freedom, for example the color of the crane arm represented can change from white to black. If the crane arm is touched a further time, this limitation can be nullified again and the display of the crane arm can for example change back from black to white. If the display is not implemented as a touch display or the like, the optionally menu-driven user interface can be navigated via an operating element of the crane controller. The display can take on the function of a status display for the operator, on which it is recognizable at a glance which crane arms or degrees of freedom are limited.

In a preferred embodiment, the crane controller is configured, in a further operating mode, to carry out a free control of the arm system on the basis of control commands input by a user. Starting from the coordinate control operating mode, a switch to the further operating mode is effected for as long as a predefinable or predefined operating element of the crane controller, preferably a dead man's switch of the crane controller, remains actuated by a user. It can thus be possible for a user to switch from the coordinate control operating mode to the further operating mode for freely controlling the arm system temporarily by actuating an operating element of the crane controller provided for this. For example, individual arms of the arm system can thereby be brought into a desired position in a targeted manner and freely or obstacles can be driven manually.

In the further operating mode for freely controlling the arm system, the crane geometry, i.e. the position of the crane arms relative to each other in a plane or relative to the crane column and the pivot position of the crane arms together with the crane column relative to a crane base, can be freely altered by a user. The user can, for example by actuating corresponding operating elements, change the relative position of the crane arms and pivot the crane arms together with the crane column relative to the crane base. In the background, the crane operation is usually monitored by safety devices which engage when operating elements which lead to a safety-critical situation are actuated by the user. For example, the stability of the crane can be monitored.

Generally, the crane controller has several operating modes. Thus, in addition to the coordinate control operating mode and a further operating mode for freely controlling the arm system, for example, there can also be a working position operating mode, in which the crane geometry is alterable in a predetermined sequence of movements by the crane controller, in order to bring the crane into a predetermined working position and/or into a predetermined parking position in a simple manner. The crane controller can also be configured in order that it memorizes the last-used operating mode before the crane is folded into its parking position. Thus, after the crane has been unfolded into its working position by means of the working position operating mode, the coordinate control operating mode is automatically switched to, if the coordinate control operating mode was active last before the crane was folded into its parking position.

Protection is also sought for a vehicle with a crane of the above-described type. The vehicle can be a truck and the crane can be a loading crane.

BRIEF DESCRIPTION OF THE DRAWINGS

Embodiment examples of the invention are discussed with reference to the figures. There are shown in.

DETAILED DESCRIPTION OF THE INVENTION

Figure 1A:
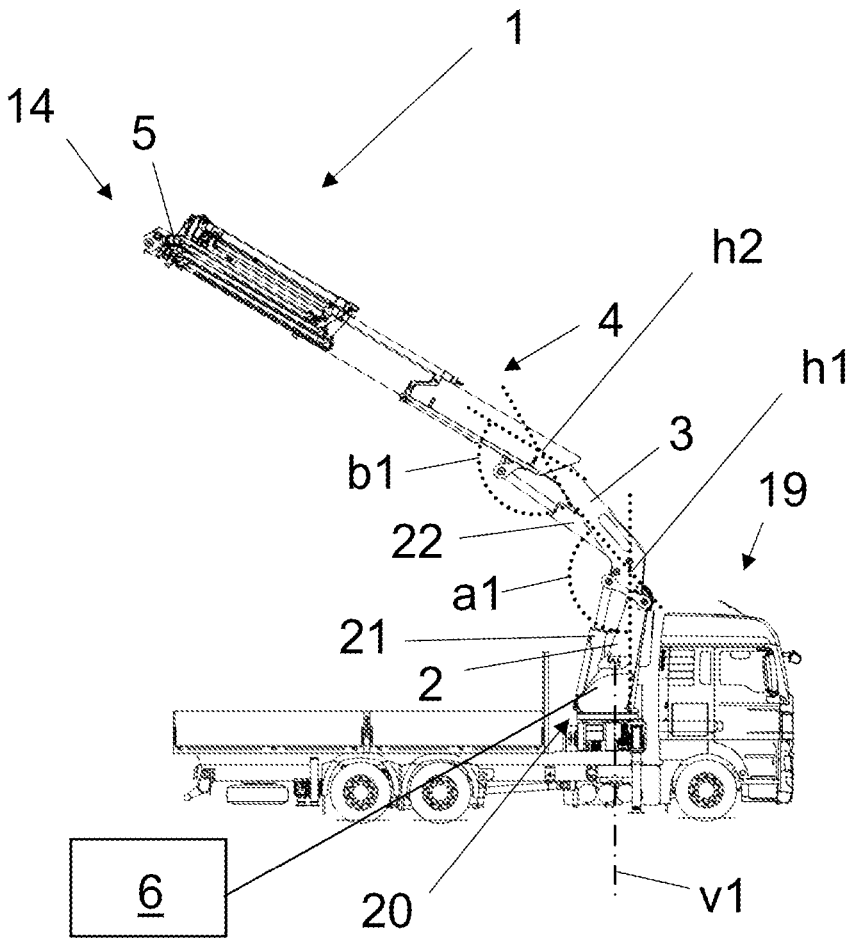
FIGS. 1*a* to 1*c* side views of different embodiments of a crane installed on a vehicle, FIGS. 2*a* to 2*c* side views of different embodiments of a crane, FIGS. 3*a* to 3*e* side views for degrees of freedom of the movement of different arms of different arm systems, FIG. 4 an embodiment of a crane with a length-adjustable main arm, FIGS. 5*a* and 5*b* two embodiments of additional devices that can be arranged on the arm system, FIGS. 6*a* and 6*b* side views of different embodiments of a crane and in each case a schematic representation of a crane controller with a sensor system, FIG. 7 an example display of the crane controller of a proposed crane with selection possibilities for operating modes displayed thereon, FIGS. 8*a* to 8*c* example embodiments of user interfaces.
Figure 1B:
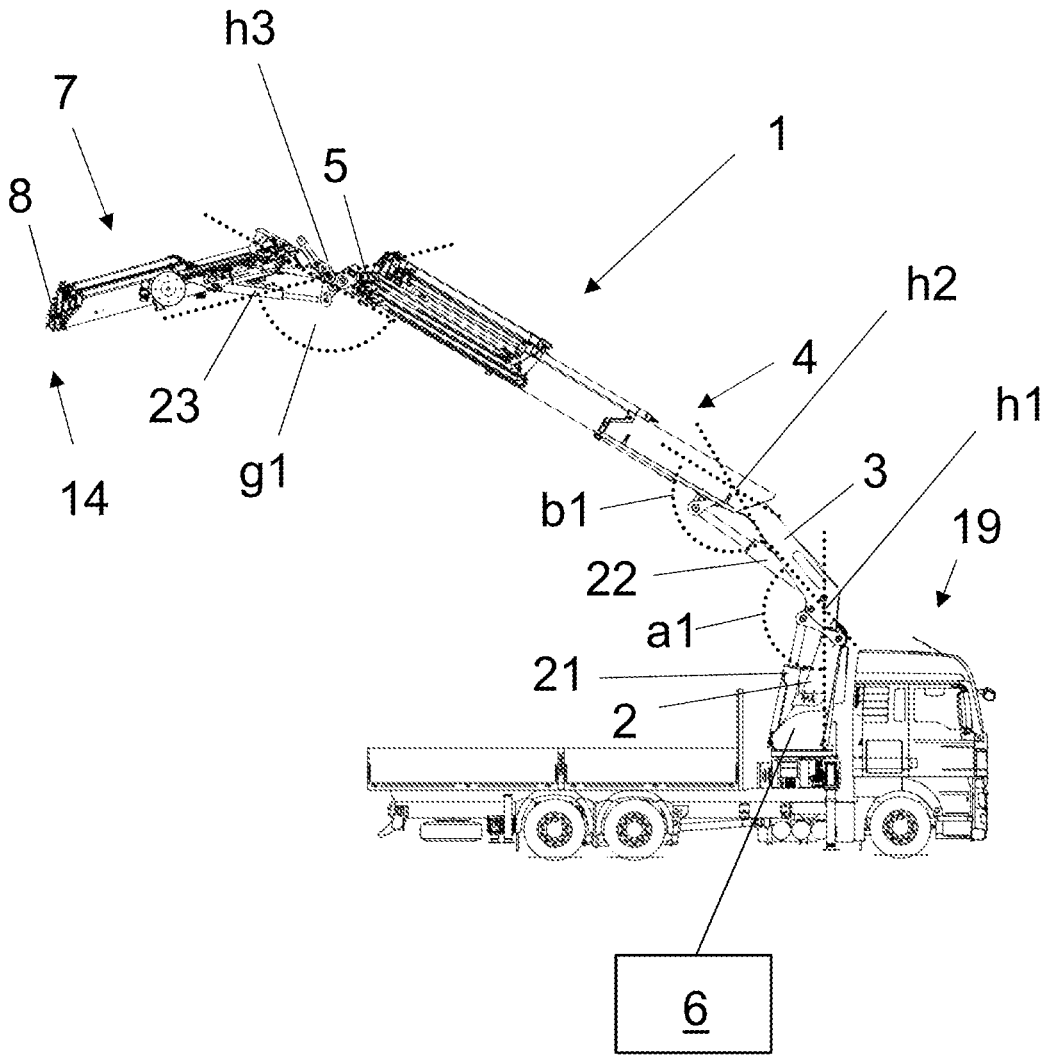
Figure 1C:
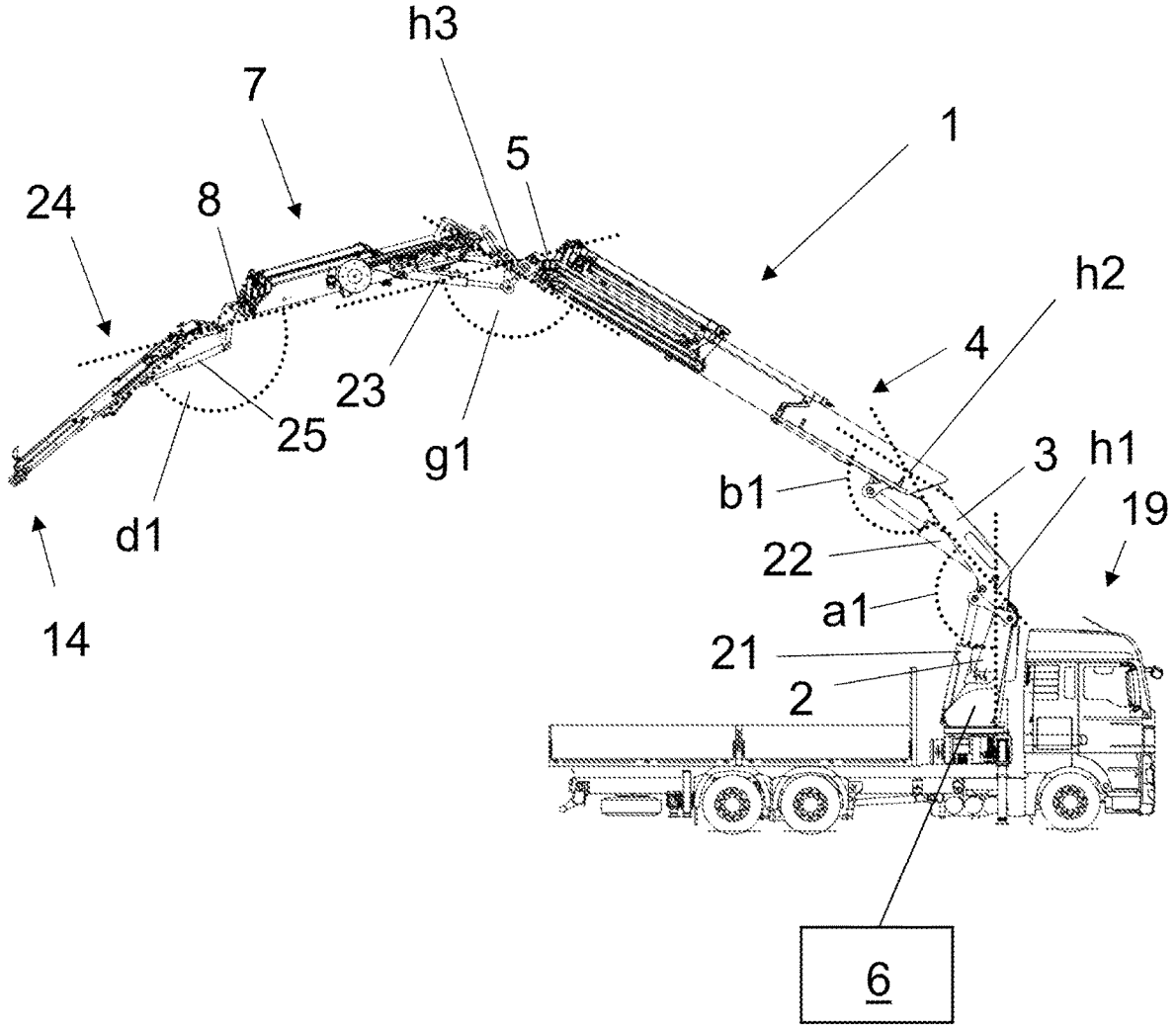
Figure 2A:
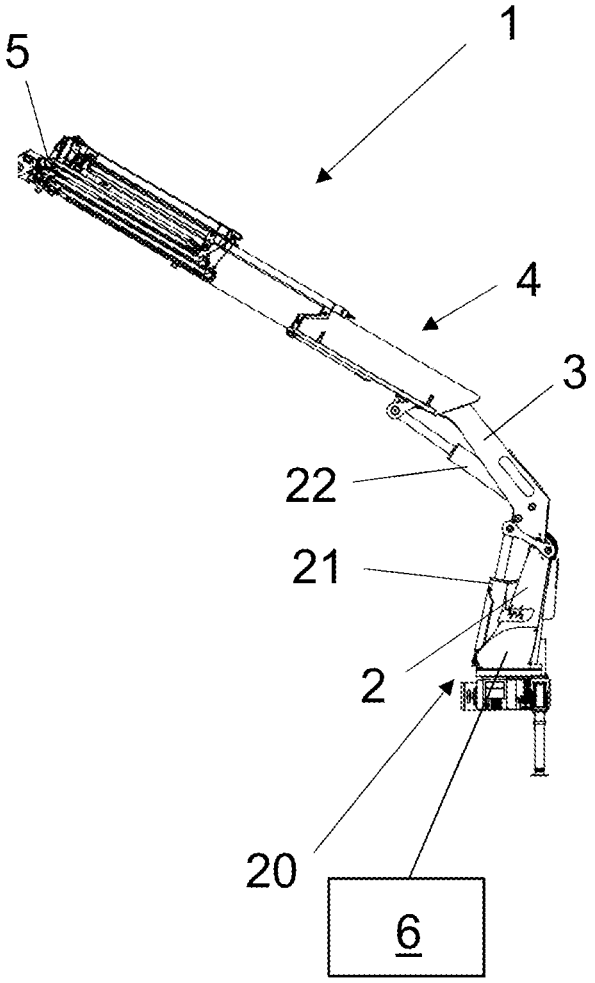
Figure 2B:
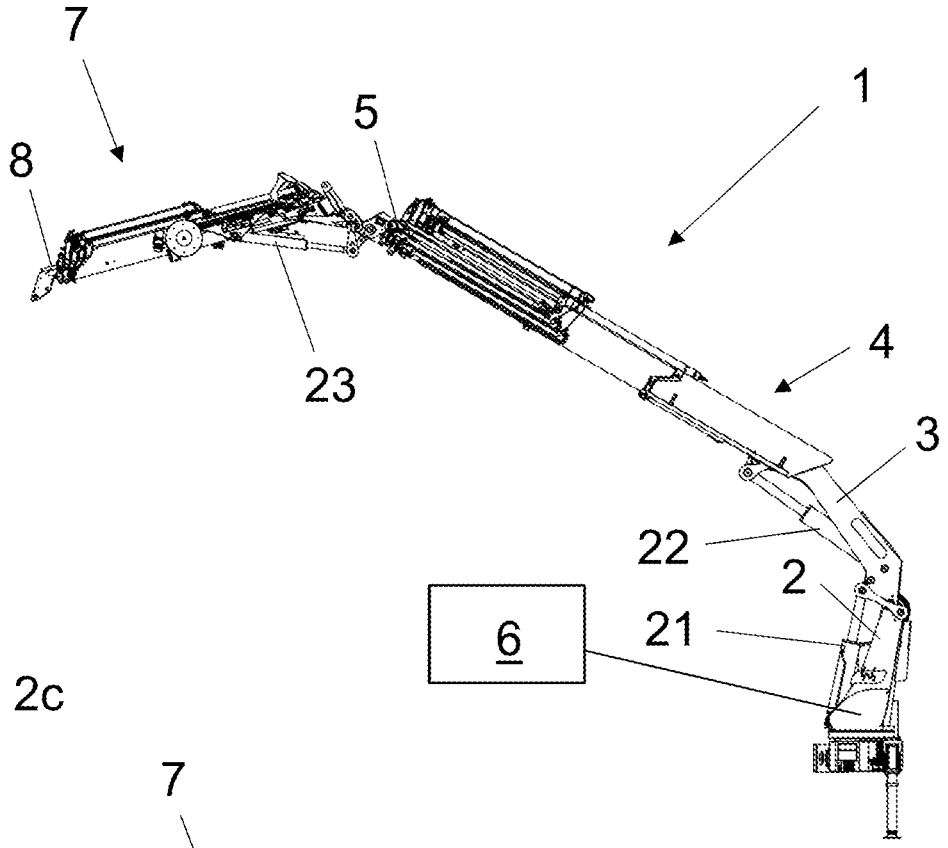
Figure 2C:
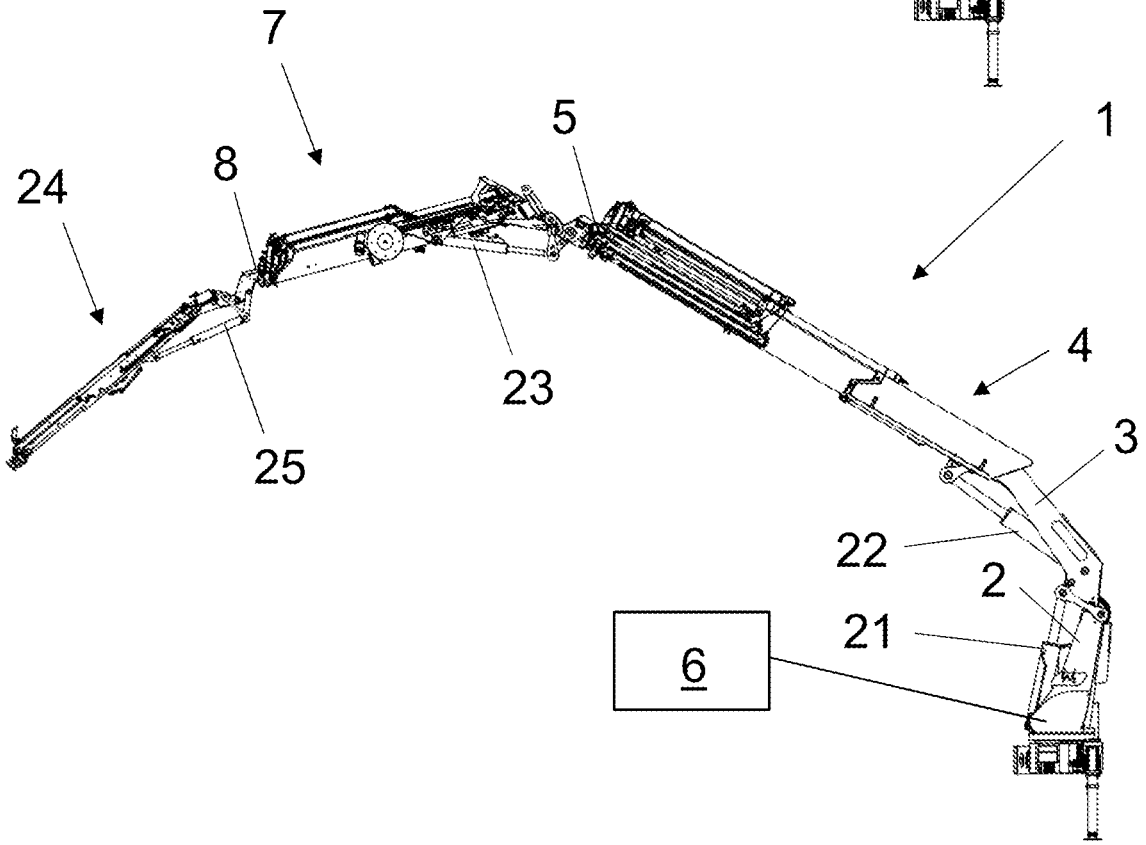

Side views of different embodiments of a crane 1 installed on a vehicle 19 are shown in FIGS. 1*a* to 1*c*. FIGS. 2*a* to 2*c* show the cranes 1 of FIGS. 1*a* to 1*c* in isolation. The degrees of freedom α, β, φ, γ, L, J, H of the movement of the individual arms 2, 3, 4, 5, 7, 8, 24 of the different arm systems of the cranes 1 are illustrated in FIGS. 3*a* to 3*e* and in FIG. 4.

A first embodiment of a proposed crane 1 is shown in FIG. 1*a*, wherein the crane 1 is formed as a loading crane or an articulated arm crane and is arranged on a vehicle 19. The crane 1, as shown, has a crane column 2 rotatable about a first vertical axis v1 by means of a slewing gear 20, a main arm 3 mounted on the crane column 2 pivotable about a first horizontal pivot axis h1 and an articulated arm 4 mounted on the main arm 3, pivotable about a second horizontal pivot axis h2, with at least one extension arm 5. A hydraulic main cylinder 21 is provided for pivoting the main arm 3 relative to the crane column 2 (represented articulation angular position a1 of the degree of freedom α). A hydraulic articulated cylinder 22 is provided for pivoting the articulated arm 4 relative to the main arm 3 (represented articulation angular position b1 of the degree of freedom β). In this embodiment of the crane 1, the crane tip 14 can be formed by the tip of the extension arm 5.

The arm system of the crane 1 shown therefore has a crane column 2, a main arm 3, an articulated arm 4 and at least one extension arm 5.

The crane 1 has a schematically represented crane controller 6 which is configured, in a coordinate control operating mode, to carry out a coordinate control of the arm system. The crane controller 6 has a user interface, not represented in more detail here, wherein the user interface has at least one function that can be chosen by a user, through which at least one of the degrees of freedom α, β, φ, L (see FIGS. 3*a* to 3*e* and FIG. 4) is limitable or limited in the coordinate control operating mode.

A second embodiment of a proposed crane 1 is shown in FIG. 1*b*, wherein the crane 1 shown therein, in addition to the equipment of the embodiment shown in FIG. 1*a*, has a second articulated arm 7, arranged on the extension arm 5 of the articulated arm 4 pivotable about a third horizontal pivot axis h3, with a second extension arm 8 mounted therein. An articulated cylinder 23 is provided for pivoting the second articulated arm 7 relative to the articulated arm 4 (represented articulation angular position g1 of the degree of freedom γ). In this embodiment of the crane 1, the crane tip 14 can be formed by the tip of the extension arm 8.

The arm system of the crane 1 shown in FIG. 1*b* therefore has a crane column 2, a main arm 3, an articulated arm 4 with at least one extension arm 5, as well as a second articulated arm 7 with at least one extension arm 8.

Analogously to the embodiment of FIG. 1*b*, for the crane 1 shown in FIG. 1*b*, in the coordinate control operating mode, one of the degrees of freedom α, β, φ, γ, L, J (see FIGS. 3*a* to 3*e* and FIG. 4) can be limitable or limited through a function that can be chosen by a user.

A third embodiment of a proposed crane 1 is shown in FIG. 1*c*, wherein the crane 1 shown therein, in addition to the configuration of the embodiment shown in FIG. 1*b*, has a further articulated arm 24 attached to the second extension arm 8 of the second articulated arm 7 pivotable about a fourth horizontal pivot axis a4. An articulated cylinder 25 is provided for pivoting the further articulated arm 24 relative to the second articulated arm 7 (represented articulation angular position d1 of the degree of freedom of the pivoting movement of the further articulated arm 24). In this embodiment of the crane 1, the crane tip 14 can be formed by the tip of the further articulated arm 24.

The arm system of the crane 1 shown in FIG. 1*c* therefore has a crane column 2, a main arm 3, an articulated arm 4 with at least one extension arm 5, a second articulated arm 7 with at least one extension arm 8, as well as a further articulated arm 24 (which can optionally be formed length-adjustable).

Analogously to the embodiments of FIGS. 1*a* and 1*b*, for the crane 1 shown in FIG. 1*c*, in the coordinate control operating mode, at least one of the degrees of freedom α, β, φ, γ, L, J (see FIGS. 3*a* to 3*e* and FIG. 4) as well as the degree of freedom of the pivoting movement of the further articulated arm 24 can be limitable or limited through a function that can be chosen by a user.

All embodiments shown can of course have a slewing gear 20.

A detail view of a crane 1 formed according to FIGS. 1*a* to 1*c* is shown in each of FIGS. 2*a* to 2*c*.

The degrees of freedom α, β, φ, γ, L, J of the movement of different arms of different arm systems are illustrated in side views in FIGS. 3*a* to 3*e*.

Figure 3A:
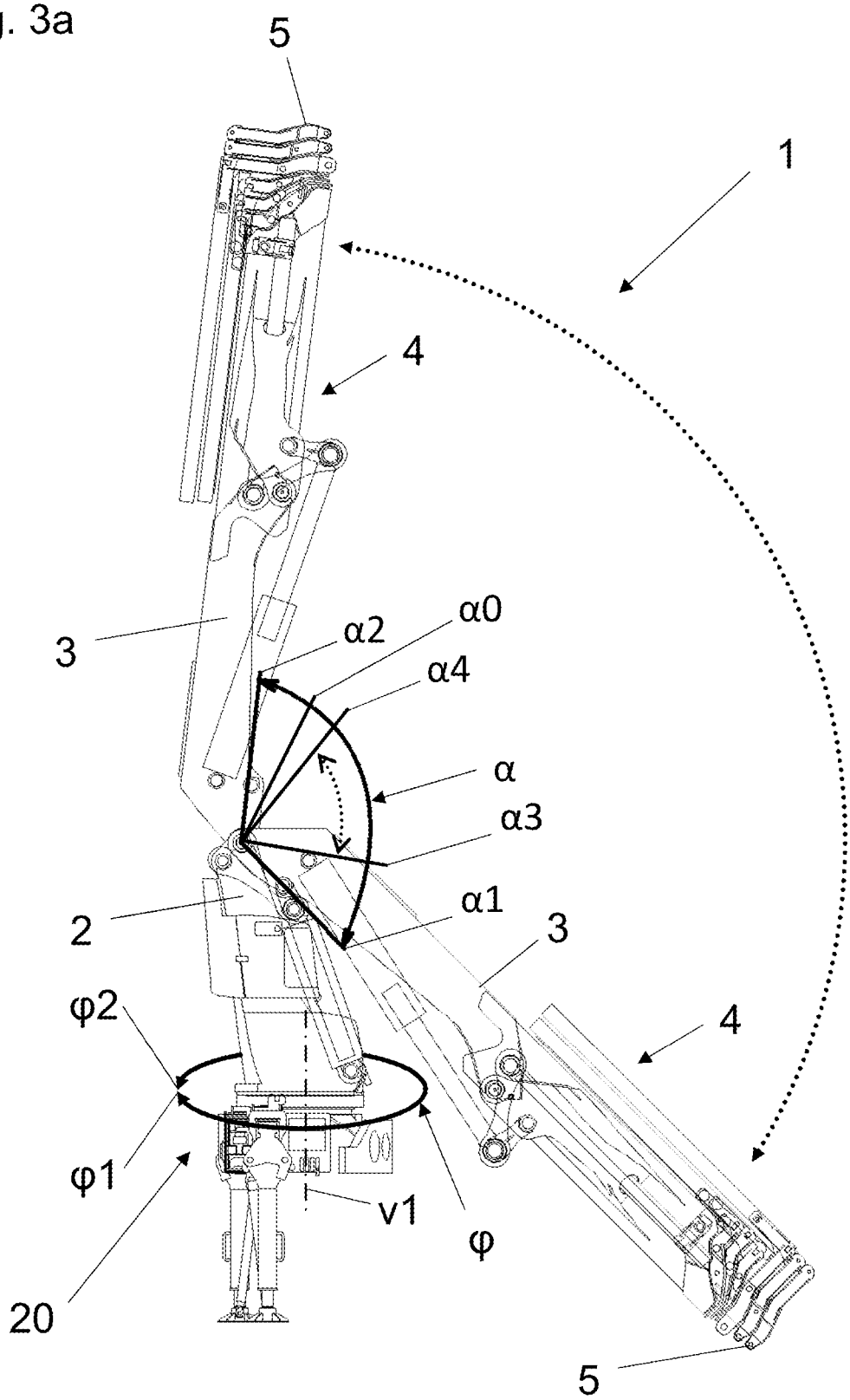
Figure 3B:
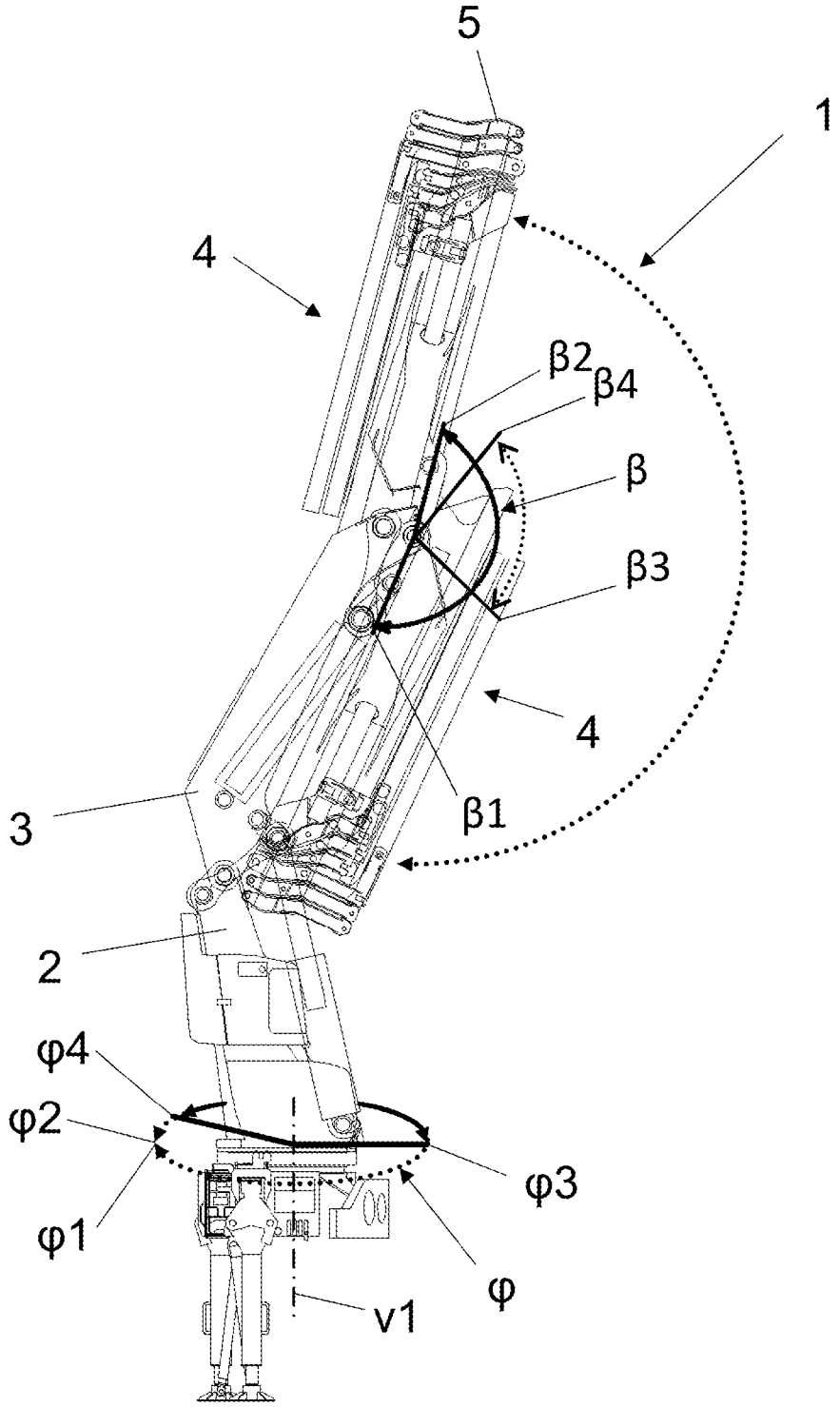
Figure 3C:
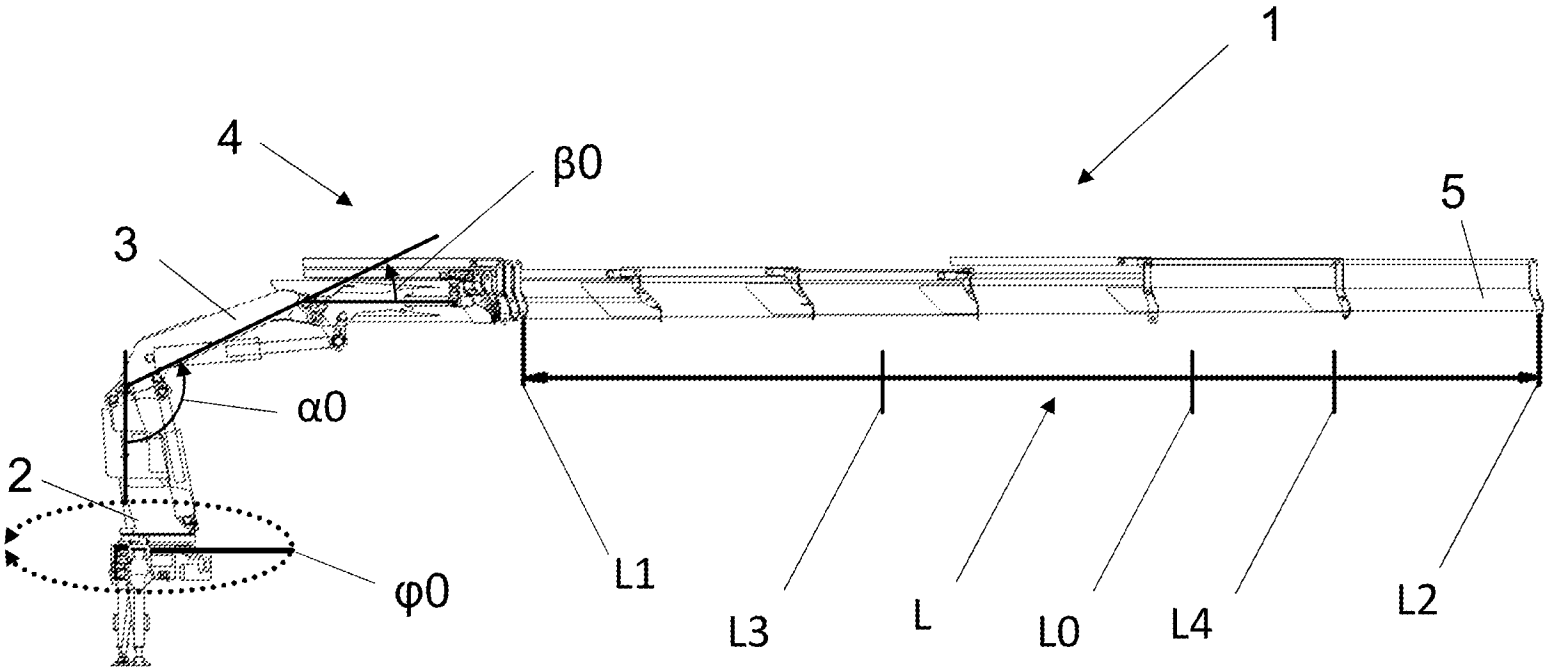

The crane 1 shown in FIGS. 3*a* to 3*c* corresponds in terms of design to those of FIGS. 1*a* and 2*a*. The articulated arm 7 shown in FIGS. 3*d* and 3*e* corresponds to that of the second articulated arms 7 in FIGS. 1*b* and 2*b*. The further articulated arm 24 of FIGS. 1*c* and 2*c* can equally be formed corresponding to the articulated arm 7 shown in FIGS. 3*e* and 3*b*.

With reference to FIGS. 3*a* to 3*c*, the crane column 2 rotatable about the axis of rotation in the form of the first vertical axis v1 is mounted pivotable over a structurally predefined crane column pivoting range φ1-φ2 and has one degree of freedom φ due to its pivotable mounting. It is conceivable that the crane column pivoting range extends over an interval of from 0° to 360°, thus the crane column is formed infinitely pivotable. The main arm 3 is mounted on the crane column 2 pivotable over a structurally predefined main arm pivoting range α1-α2 and has one degree of freedom α due to its pivotable mounting. The articulated arm 4 is mounted on the main arm 3 pivotable over a structurally predefined articulated arm pivoting range β1-β2 and has one degree of freedom β due to its pivotable mounting. The extension arm 5 is mounted in the articulated arm 4 displaceable over a structurally predefined extension range L1-L2 and has one degree of freedom L due to its displaceable mounting.

Figure 3D:
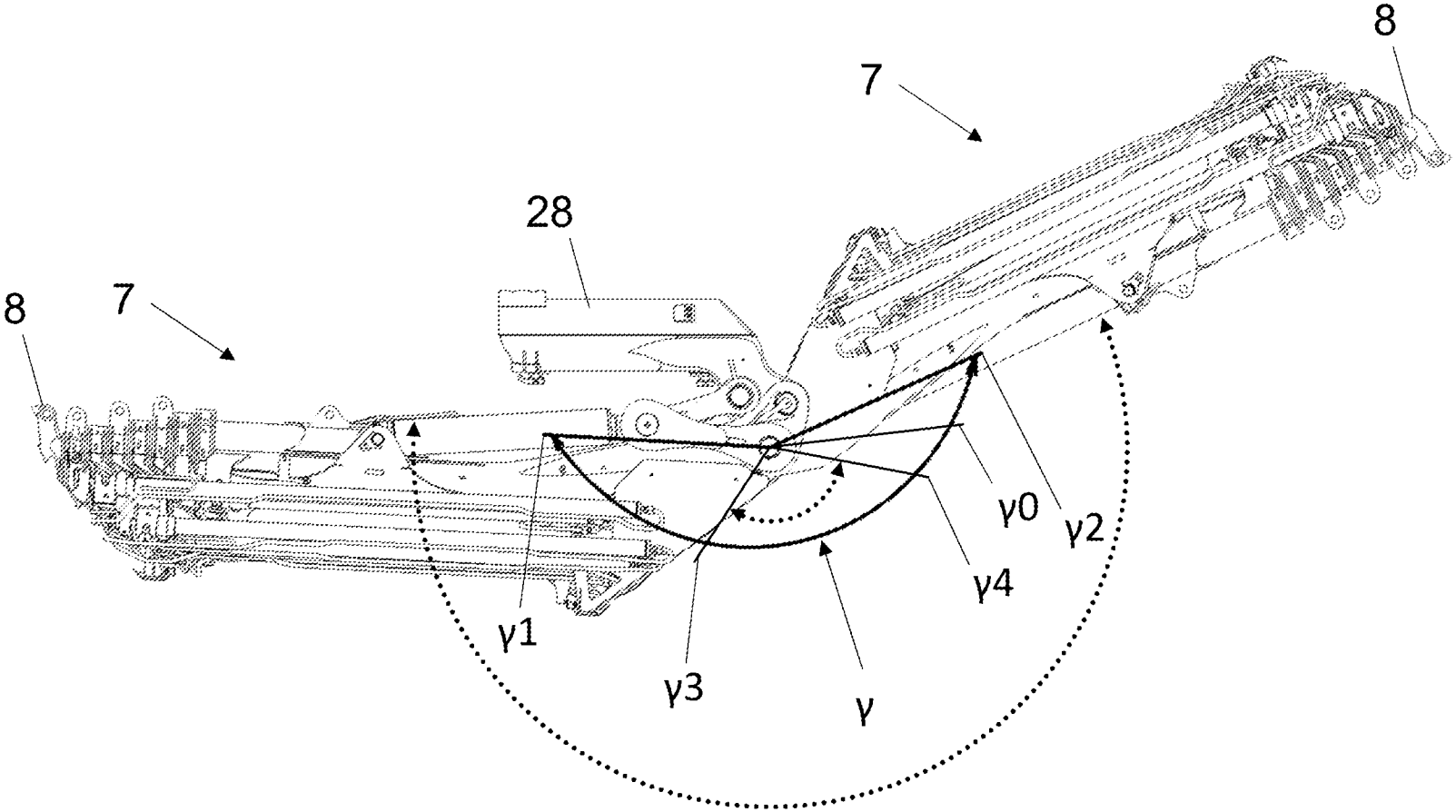
Figure 3E:
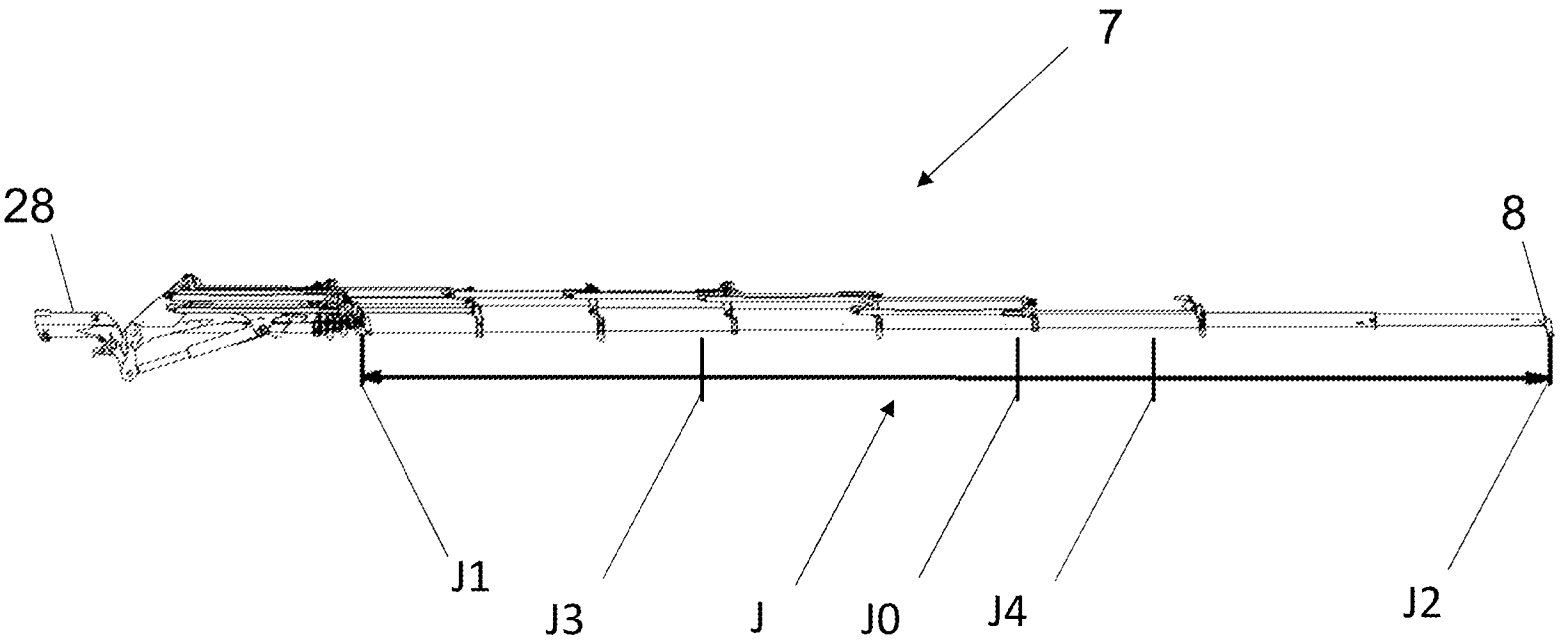

FIGS. 3*d* and 3*e* show in isolation an articulated arm 7 which can be mounted over a connecting region 28 on the extension arm 5 of the crane 1 of FIGS. 3*a* to 3*c* pivotable over a structurally predefined second articulated arm pivoting range γ1-γ2 and has one degree of freedom γ due to a pivotable mounting, and which comprises at least one second extension arm 8, which is mounted in the second articulated arm 7 displaceable over a structurally predefined second extension arm extension range J1-J2 and has one degree of freedom J due to its displaceable mounting.

Figure 4:
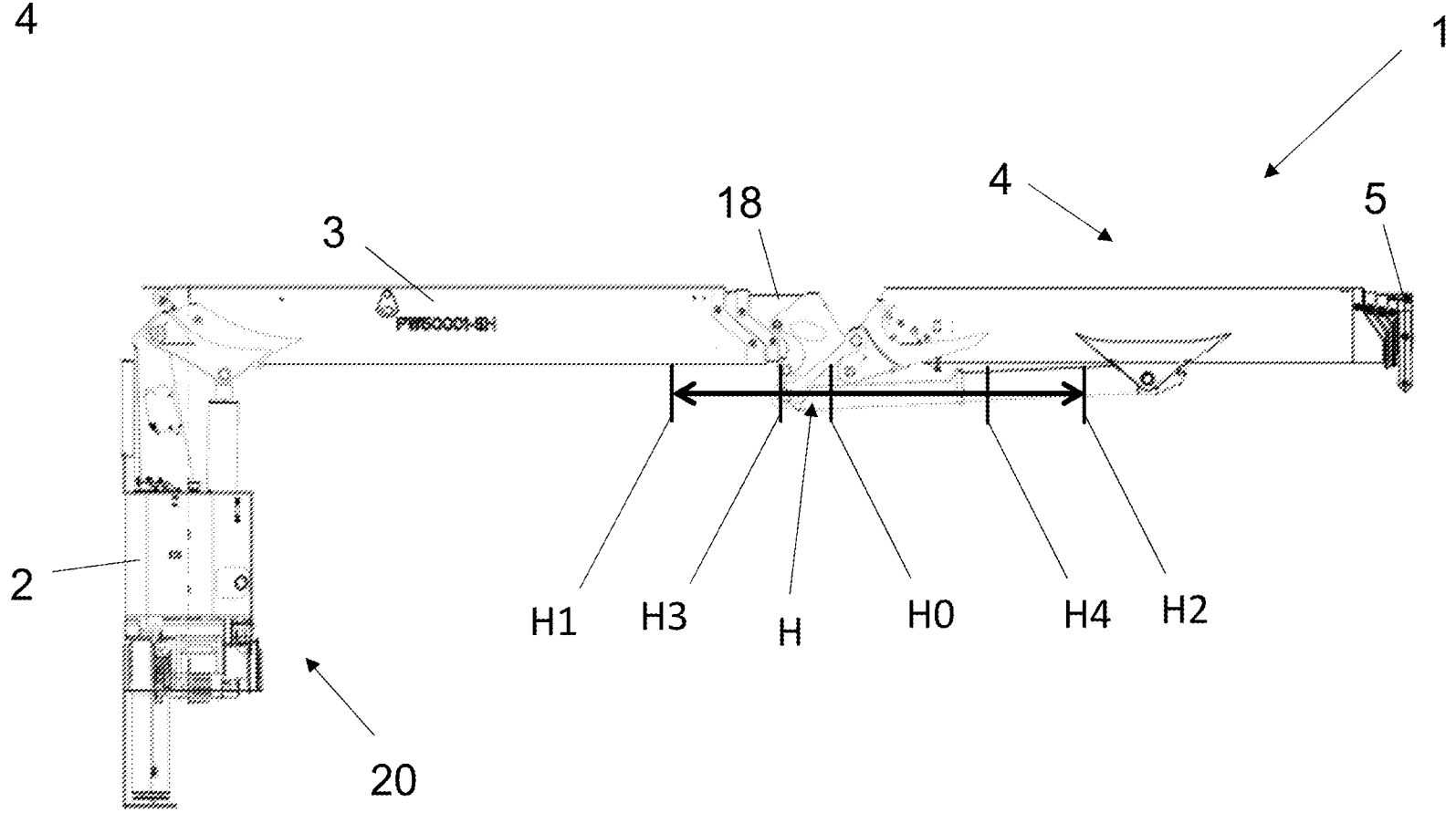

FIG. 4 shows an embodiment of a crane 1 the arm system of which, unlike the previously discussed embodiments, additionally has at least one main arm extension arm 18, which is mounted in the main arm 3 displaceable over a structurally predefined (and only schematically represented) extension range H1-H2 and has one degree of freedom H due to its displaceable mounting.

The arm system of the crane 1 shown in FIG. 4 therefore has a crane column 2, a main arm 3 with at least one main arm extension arm 18, an articulated arm 4 with at least one extension arm 5.

Analogously to the previously discussed embodiments, for the crane 1 shown in FIG. 4, in the coordinate control operating mode, at least one of the degrees of freedom α, β, φ, H, L can be limitable or limited through a function that can be chosen by a user.

As represented in FIGS. 3*a* to 3*e* and 4, the degrees of freedom α, β, φ, γ, L, J, H of the movement of different arms can be settable or set to a predefined or predefinable value α0, β0, φ0, γ0, L0, J0, H0, and/or can be restrictable or restricted to a predefinable or predefined partial range α1<α3-α4<α2; β1<β3-β4<β2; φ1<φ3-φ4<φ2; γ1<γ3-γ4<γ2; L1<L3-L4<L2; J1<J3-J4<J2; H1<H3-H4<H2.

Figure 5A:
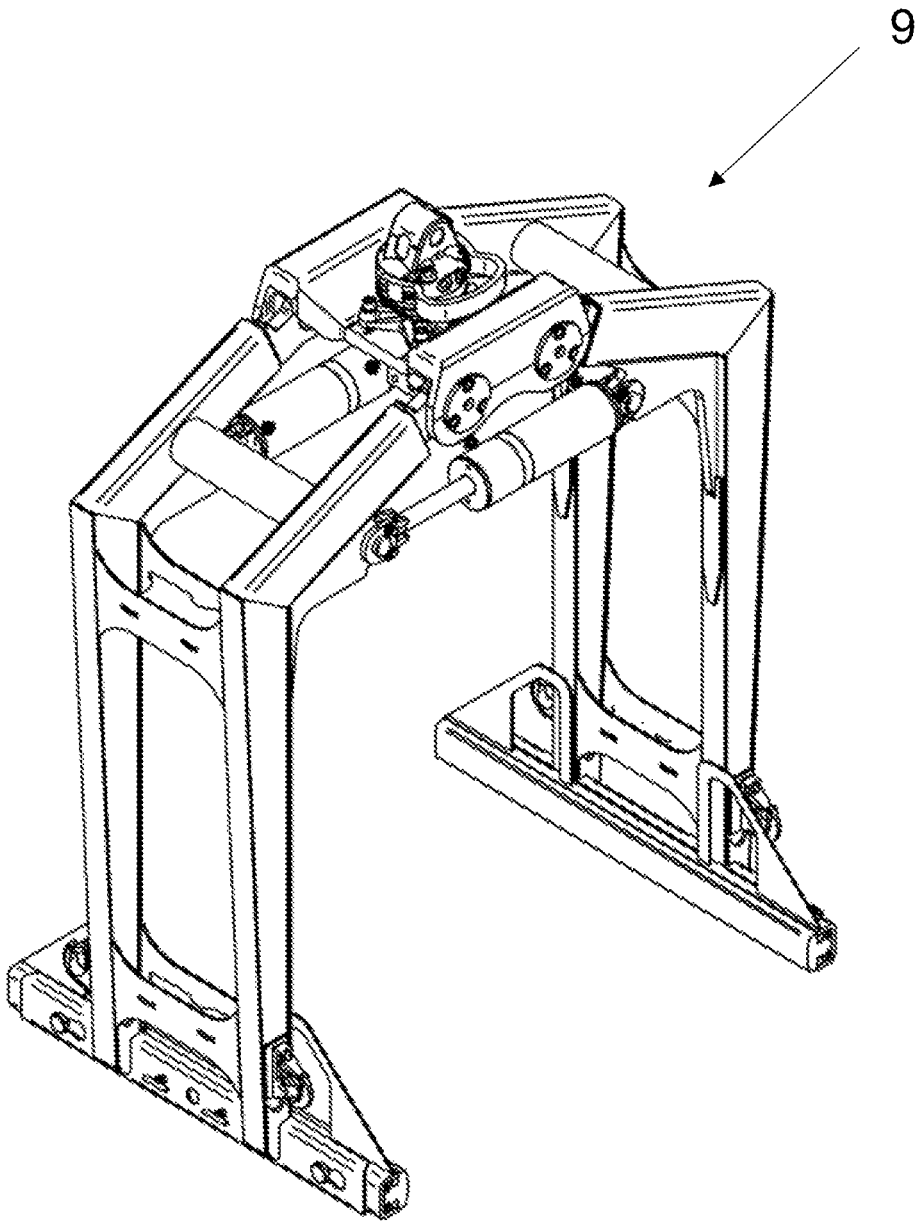
Figure 5B:
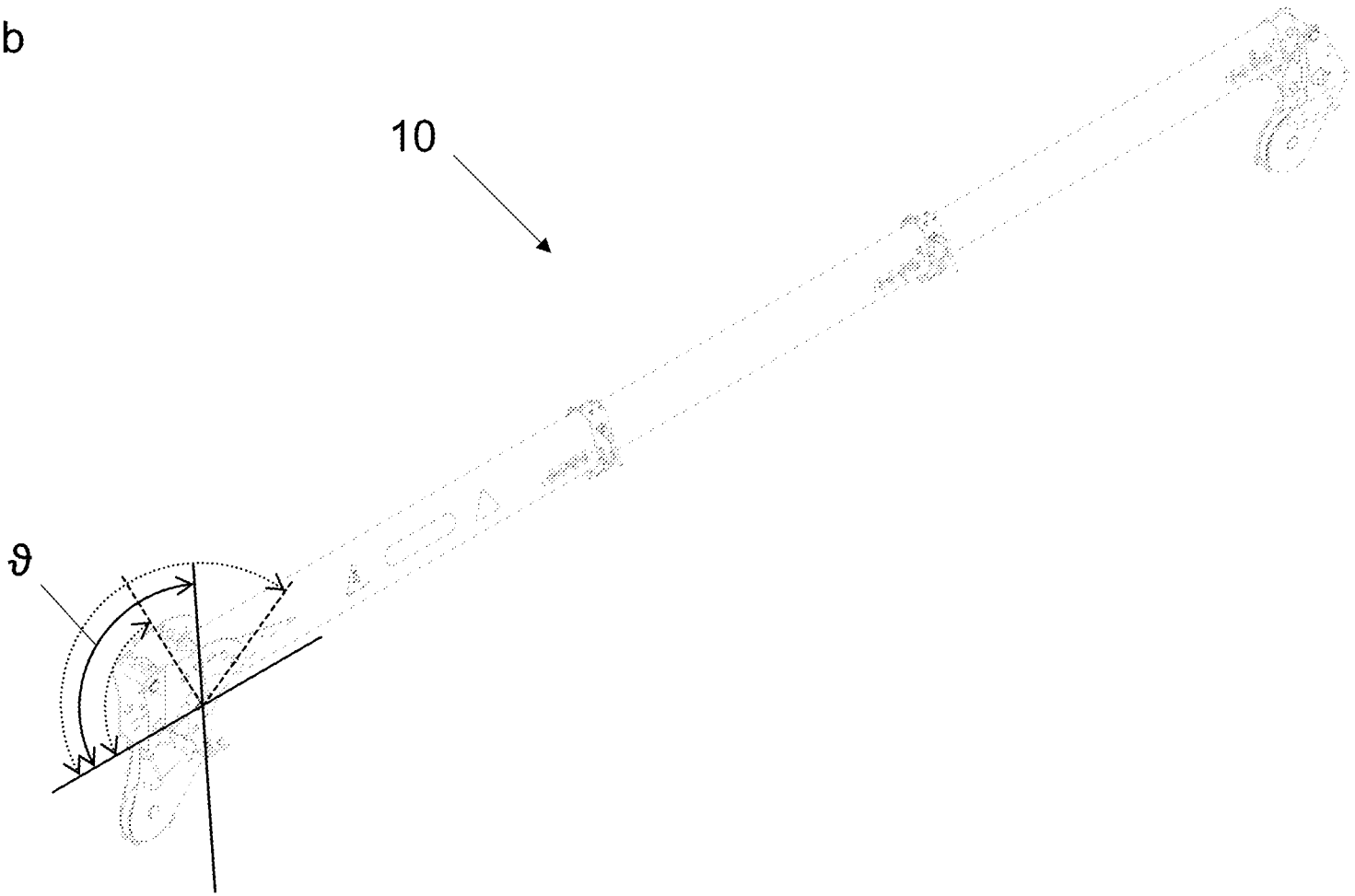

Two embodiments of additional devices that can be arranged on the arm system are shown in FIGS. 5*a* and 5*b*, in the form of an implement 9, designed by way of example as a brick stack grapple, and a static arm extension 10.

An embodiment of an implement 9 which can be arranged on an extension arm of a crane is shown in FIG. 5*a*. Dimensions and function range of the implement can be stored in a crane controller, not represented here, and taken into account in the calculations of the crane controller.

The static arm extension 10 represented in FIG. 5*b* can be arranged on an extension arm of a crane via a corresponding receiver. Through a receiver that is formed adjustable, the arm extension 10 can be arranged on an extension arm at an angle ϑ (here plotted compared with an imaginary vertical). The arm extension 10 can be formed length-adjustable. The information about the arm extension 10, such as for instance the length of the arm extension 10 and the angle ϑ, can be stored in a crane controller, not represented here, and taken into account in calculations of the crane controller, specifically in relation to the position of the crane tip (regarding this see FIGS. 11*b* and 11*d*).

Figure 6A:
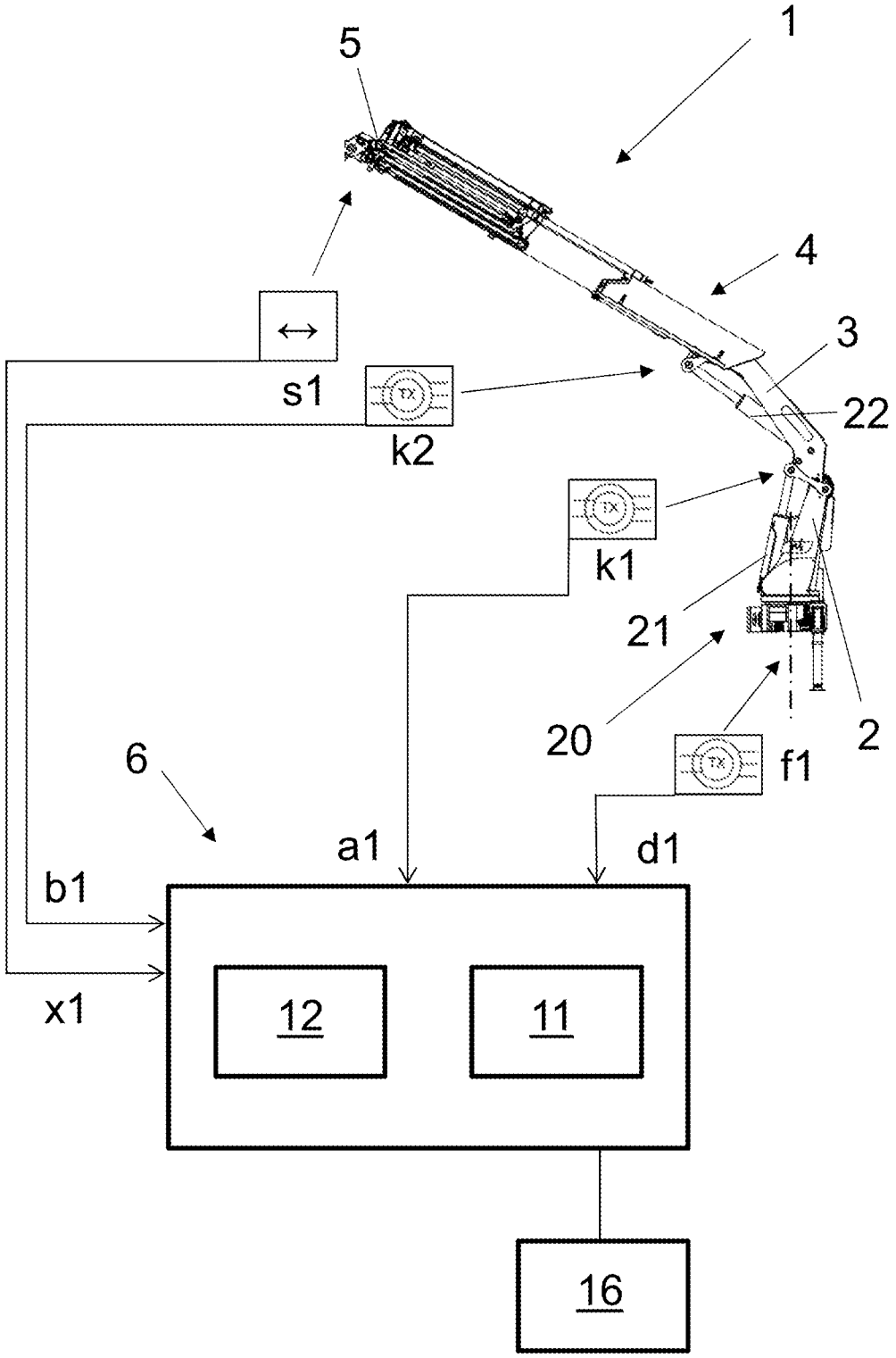

An embodiment of the crane 1 according to FIGS. 1*a* and 2*a* is shown in FIG. 6*a*. In addition, a schematic representation of the crane controller 6 is shown which is configured, in a coordinate control operating mode, to carry out a coordinate control of the arm system.

The crane controller 6 has a user interface, not represented in more detail here, wherein the user interface has at least one function that can be chosen by a user, through which at least one of the degrees of freedom α, β, φ, L is limitable or limited in the coordinate control operating mode.

The crane controller 6 represented schematically here has several signal inputs to which signals of the sensor system built into the crane 1 can be fed. Furthermore, the crane controller 6 has a memory 11, in which for example program data for operating modes and calculation models of the crane controller 6 as well as incoming signals can be stored, and a processing unit 12, with which, among other things, incoming signals and data stored in the memory 11 can be processed. The crane controller 6 can also comprise a display 16. A communication of the crane controller 6 with the display 16 can be wired and/or wireless. In the embodiment shown in FIG. 6*a*, the sensor system for detecting the geometry of the crane 1 comprises an angle-of-rotation sensor f1 for detecting the angle of rotation d1 of the crane column 2, an articulation-angle sensor k1 for detecting the articulation angle a1 of the main arm 3 relative to the crane column 2, an articulation-angle sensor k2 for detecting the articulation angle b1 of the articulated arm 4 relative to the main arm 3 as well as an extension-position sensor s1 for detecting the extension position x1 of the extension arm 5.

Figure 6B:
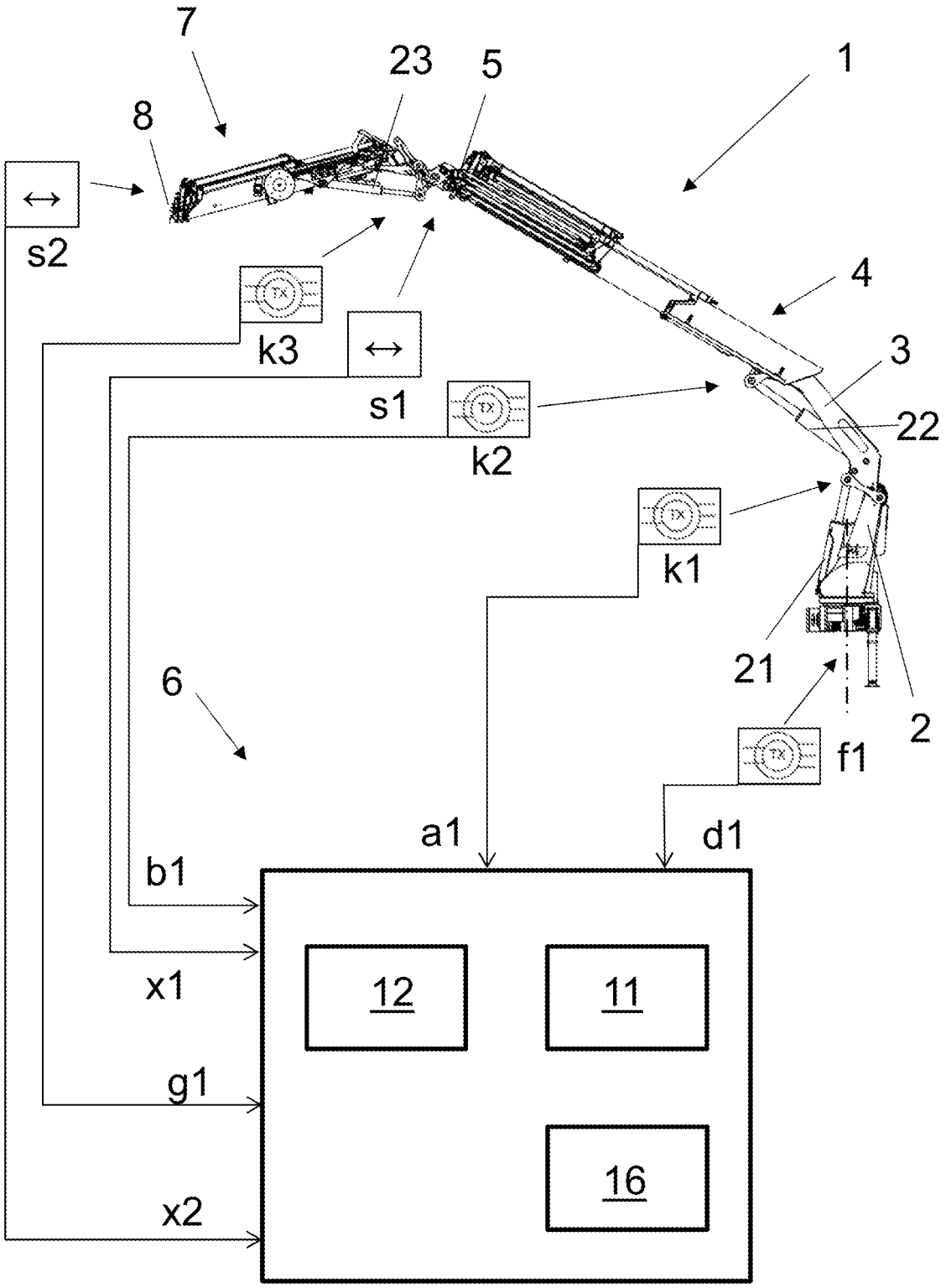

Analogously to FIG. 6*a*, an embodiment of the crane 1 according to FIGS. 1*b* and 2*b* is shown in FIG. 6*b*. The configuration of the crane 1, as shown, comprises a second articulated arm 7 arranged on the extension arm 5 of the articulated arm 4. As an additional sensor system for detecting the operating parameters of the crane 1, an articulation-angle sensor k3 for detecting the articulation angle g1 of the second articulated arm 7 relative to the articulated arm 5 and an extension-position sensor s2 for detecting the extension position x2 of the second extension arm 8 are provided.

An analogous embodiment of the arrangement shown in FIGS. 6*a* and 6*b* consisting of a crane 1 according to FIGS. 1*c* and 2*c* and a crane controller 6 is equally conceivable.

Figure 7:
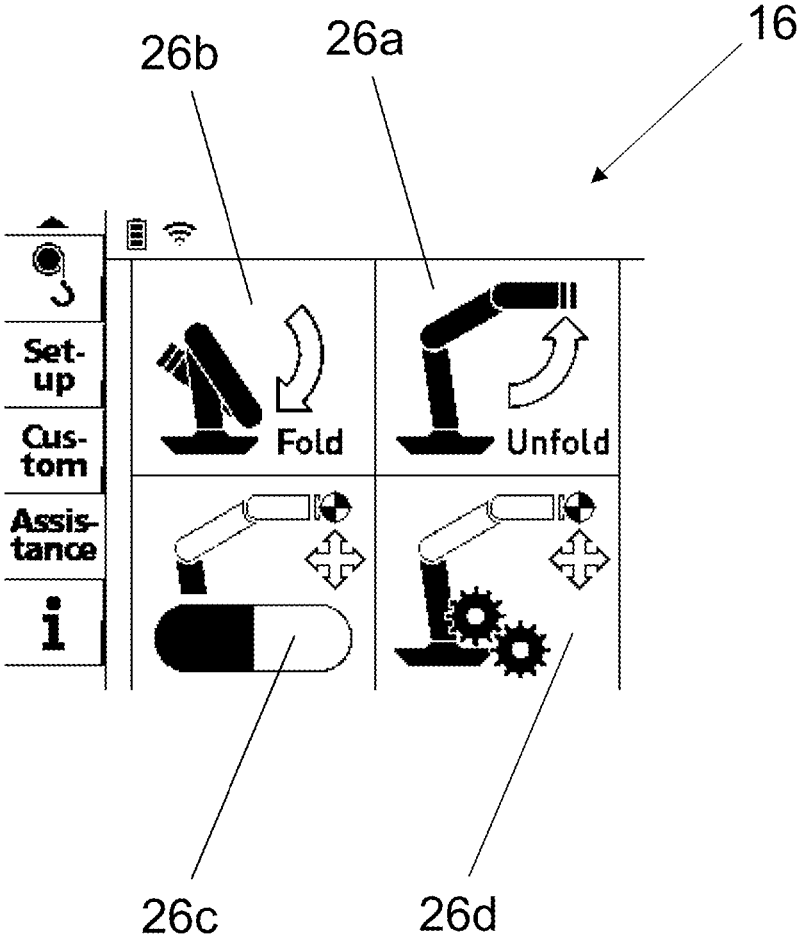
Figure 14:
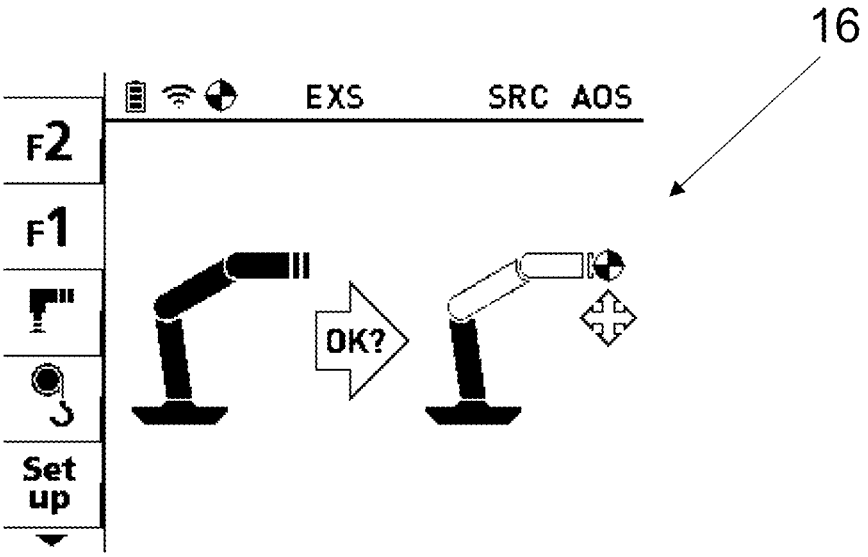

FIG. 7 shows by way of example a display 16 of the crane controller 6 of a proposed crane 1. The display 16 can serve purely for display, but can also be formed as a touch display and thus simultaneously represent a menu-driven user interface of the crane controller 6. Different operating modes of the crane controller 6 can be selected via operating mode functions 26*a*, 26*b*, 26*c* that can be chosen by a user. Thus, in this example, a working position operating mode, in which the crane geometry of the crane 1 is brought into a working position in a predetermined sequence of movements, can be selected via a first operating mode function 26*a* that can be chosen. A parking position operating mode, in which the crane geometry of the crane 1 is brought into a parking position in a predetermined sequence of movements, can be selected via a second operating mode function 26*b* that can be chosen. The coordinate control operating mode, in which the crane controller 6 is configured to carry out a coordinate control of the arm system, can be selected via a third operating mode function 26*c* that can be chosen. When the operating mode function 26*c* is selected, a safety query to be confirmed by a user, as represented in FIG. 14, can optionally be effected. Settings of the coordinate control operating mode (for example configuration and/or ranking of operating profiles, specifications for different degrees of freedom, etc.) can be altered via the fourth operating mode function 26*d* that can be chosen.

Figure 8A:
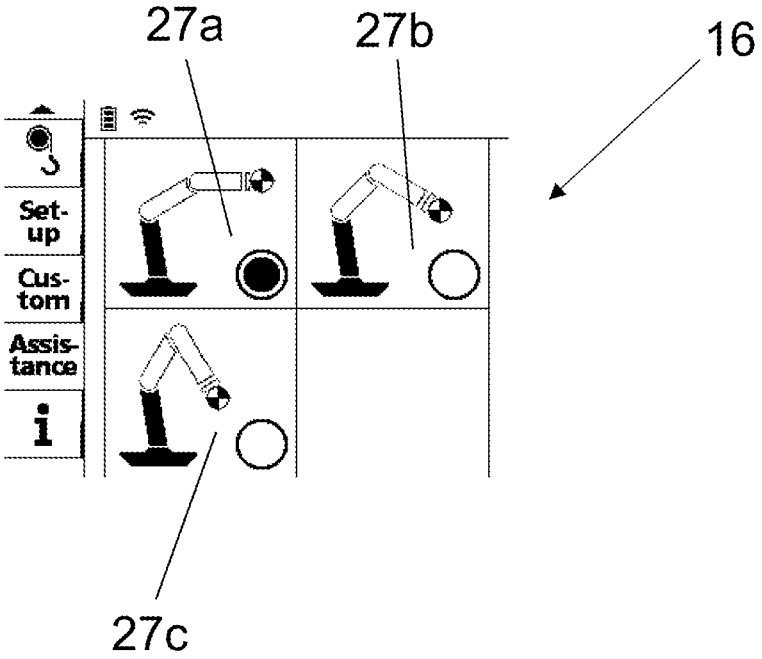
Figure 8B:
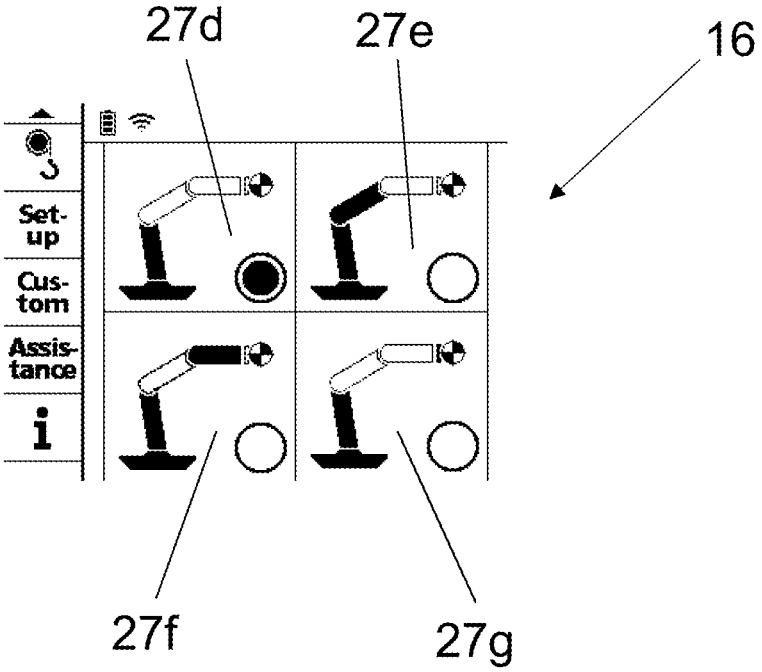
Figure 8C:
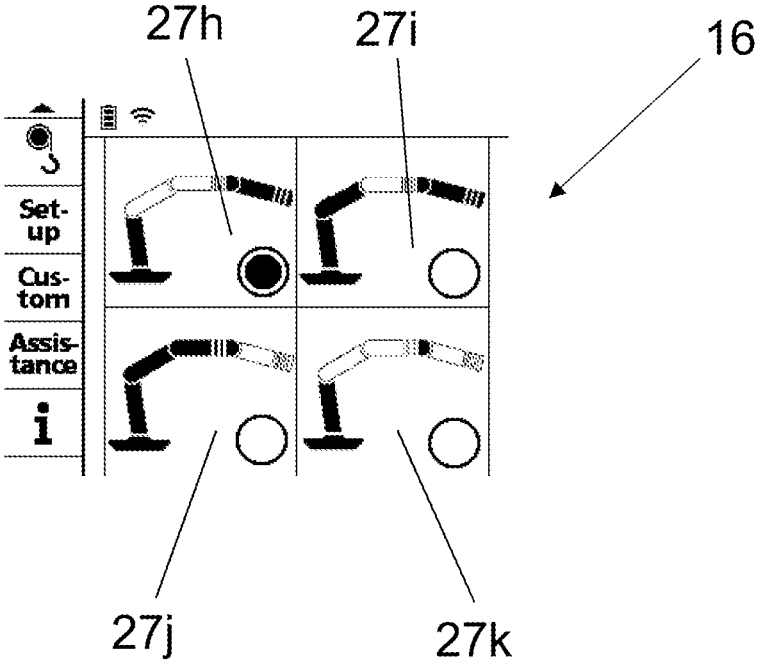

FIGS. 8*a*, 8*b* and 8*c* show by way of example embodiments of user interfaces, which are in each case formed by displays 16 of crane controllers 6, which can be formed as touch displays. The functions 27*a*, 27*b*, 27*c*, 27*d*, 27*e*, 27*f*, 27*g*, 27*h*, 27*i*, 27*j*, 27*k* represented here that can be chosen by a user are used in each case for the selection of an operating profile of the crane controller 6 linked to the respective function 27*a*, 27*b*, 27*c*, 27*d*, 27*e*, 27*f*, 27*g*, 27*h*, 27*i*, 27*j*, 27*k* in the coordinate control operating mode. In each of the operating profiles that can be selected, at least two arm selections in the form of a subset of the arms 2, 3, 4, 5, 7, 8, 18 of the arm system of the crane 1 are stored in a predefined or predefinable ranking from a higher prioritization to a lower prioritization or are continuously determined during operation. The crane controller 6 is formed to use and actuate the arm selections stored in the selected operating profile according to their prioritization for carrying out the coordinate control of the arm system.

The function 27*a*, 27*d* and 27*h* respectively selected in FIGS. 8*a* to 8*c* is marked on the display 16 by a black dot (filled circle), with the result that the user immediately sees which operating profile is selected. The crane represented in the pictograms of FIGS. 8*a* and 8*b* can be based on an embodiment of a crane 1 according to FIGS. 1*a* and 2*a*, respectively, and the crane represented in FIG. 8*c* can be based on an embodiment of a crane 1 according to FIGS. 1*b* and 2*b*, respectively. The same is conceivable for an embodiment of a crane 1 according to FIGS. 1*c* and 2*c*, respectively.

The menus shown in FIGS. 8*a* to 8*c* can for example correspond in each case to a submenu, which can be reached by selecting the function 26*d* in the menu of FIG. 7.

With the functions 27*a*, 27*b* and 27*c* shown in FIG. 8*a*, an arm system of a crane 1 can be held in a preferred arm position in a coordinate control operating mode. A selection of the function 27*a* can for example correspond to a default configuration of the crane 1, in which the arm system is held in an arm position that is optimized in terms of utilization and range. More precise details regarding this are to be found in FIG. 9*a*.

A selection of the function 27*b* can for example correspond to a configuration of the crane 1 in which the arm system is held in an arm position which is ideally suitable for transporting bulky loads. Details regarding this are to be found in FIG. 9*b*.

A selection of the function 27*c* can for example correspond to a configuration of the crane 1 in which specifically the main arm 3 of the arm system is held in a preferred position. Details regarding this are to be found in FIG. 9*c*.

A selection of the functions 27*d* to 27*g* in FIG. 8*b* can bring about a use of an arm selection in the form of a subset (3, 4, 5; 4, 5; 3, 5; 3, 4) of the set of the arms (3, 4, 5) of the arm system when the coordinate control of the arm system of a crane 1 is carried out according to FIG. 1*a* or 2*a*. A selection of the function 27*d* can correspond to an arm selection in which, when the coordinate control is carried out, the main arm 3 and the articulated arm 4, the articulated arm 4 and the extension arm 5, or the main arm 3 and extension arm 5 are used depending on the suitability or prioritization. A selection of the function 27*e* can correspond to an arm selection in which, when the coordinate control is carried out, the articulated arm 4 and the extension arm 5 are used. A selection of the function 27*f* can correspond to an arm selection in which, when the coordinate control is carried out, the main arm 3 and the extension arm 5 are used. A selection of the function 27*g* can correspond to an arm selection in which, when the coordinate control is carried out, the main arm 3 and the articulated arm 4 are used. A selection of the respective functions will limit the remaining degrees of freedom of the movement of the arms of the arm system.

Analogously thereto, for a selection of the functions 27*h* to 27*k* in FIG. 8*c*, when the coordinate control of the arm system of a crane 1 is carried out according to FIG. 1*b* or 2*b*, an arm selection of a corresponding subset of the set of the arms (3, 4, 5, 7, 8) of the arm system can be used.

Figure 9A:
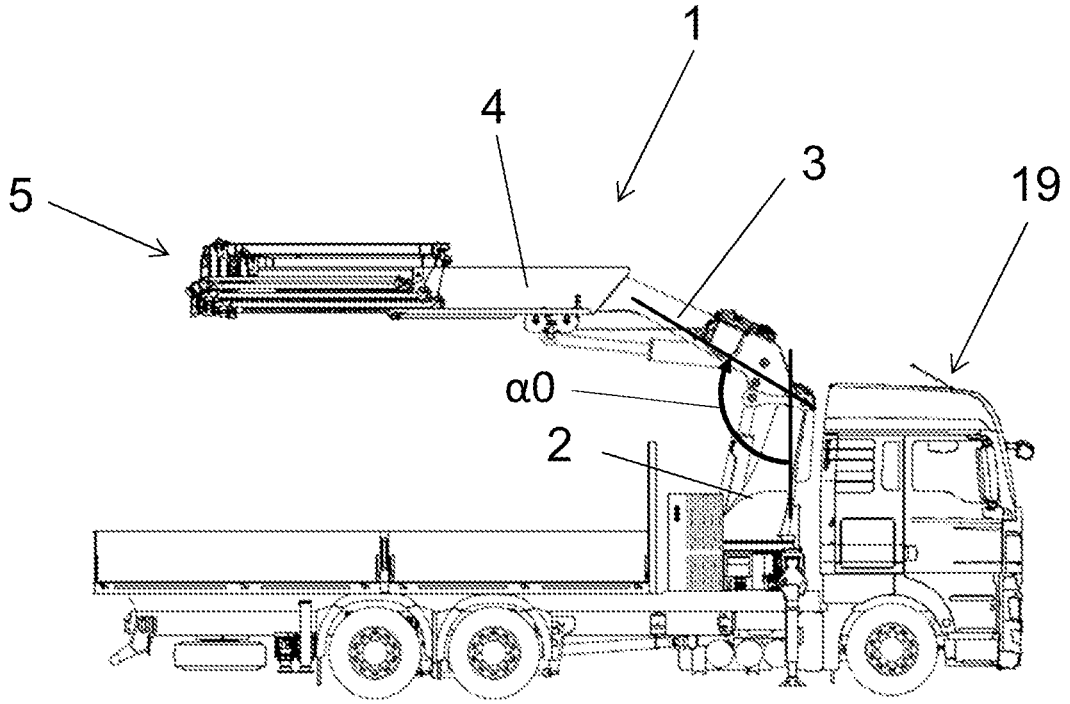
FIGS. 9*a* to 9*c* show possible application examples which make use of operating profiles, FIGS. 10*a* to 10*e* embodiments of user interfaces, FIGS. 11*a* to 11*d* further embodiments of user interfaces and an input screen, FIG. 12 a possible limitation of the degree of freedom β of the articulated arm, FIG. 13*a* the display of a crane controller of a proposed crane, FIG. 13*b* a control panel of the crane controller according to FIG. 13*a*, and FIG. 14 a further embodiment of a user interface.
Figure 9B:
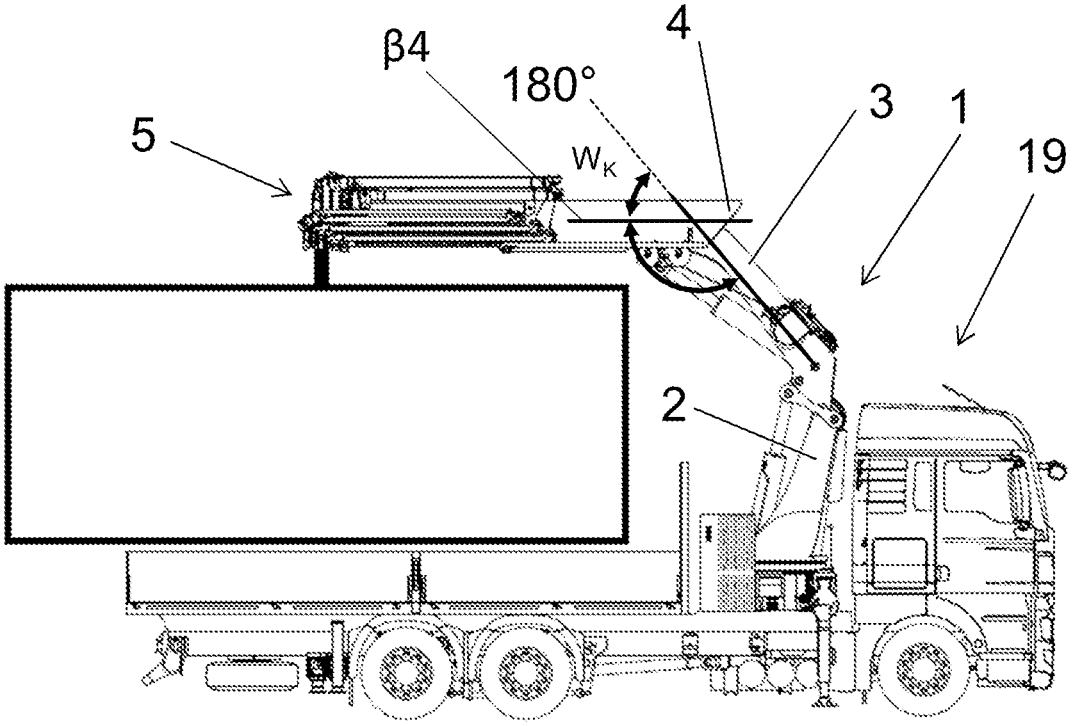
Figure 9C:
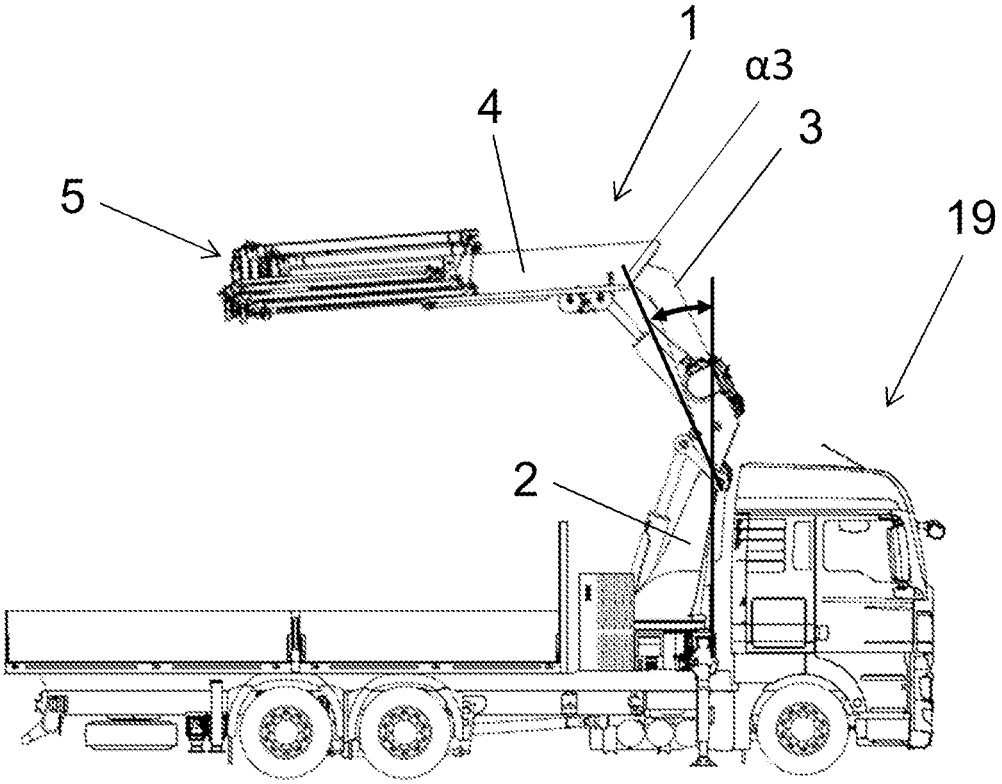
Figure 10A:
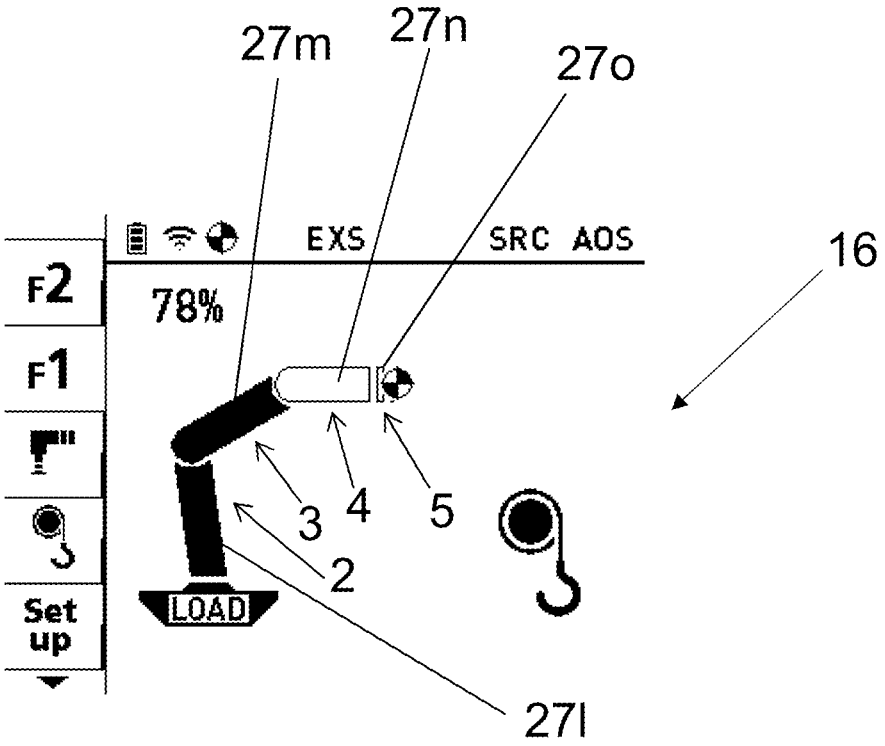
Figure 10B:
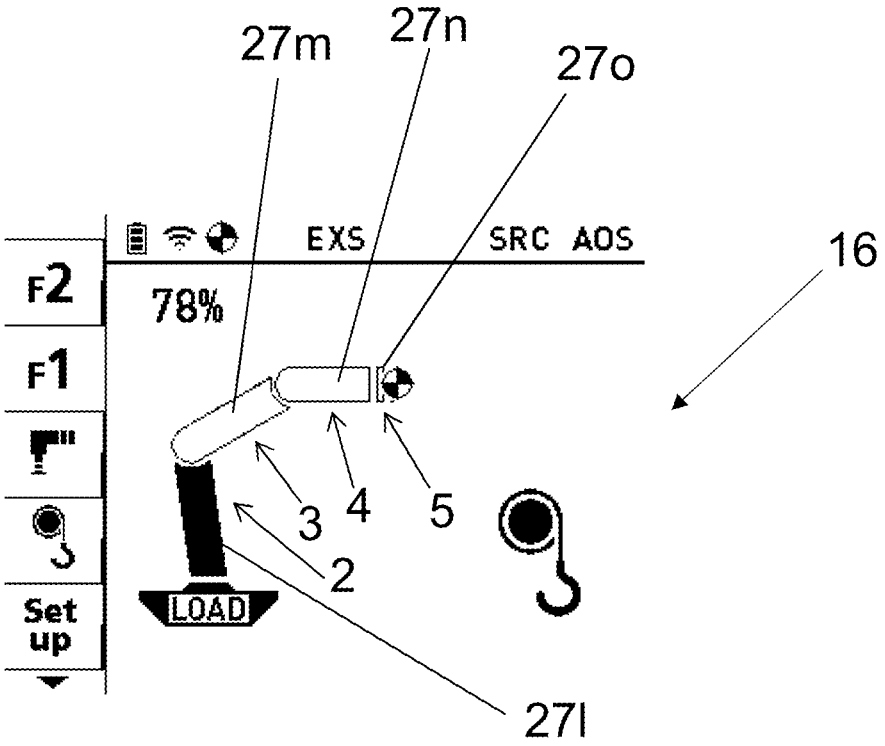
Figure 10C:
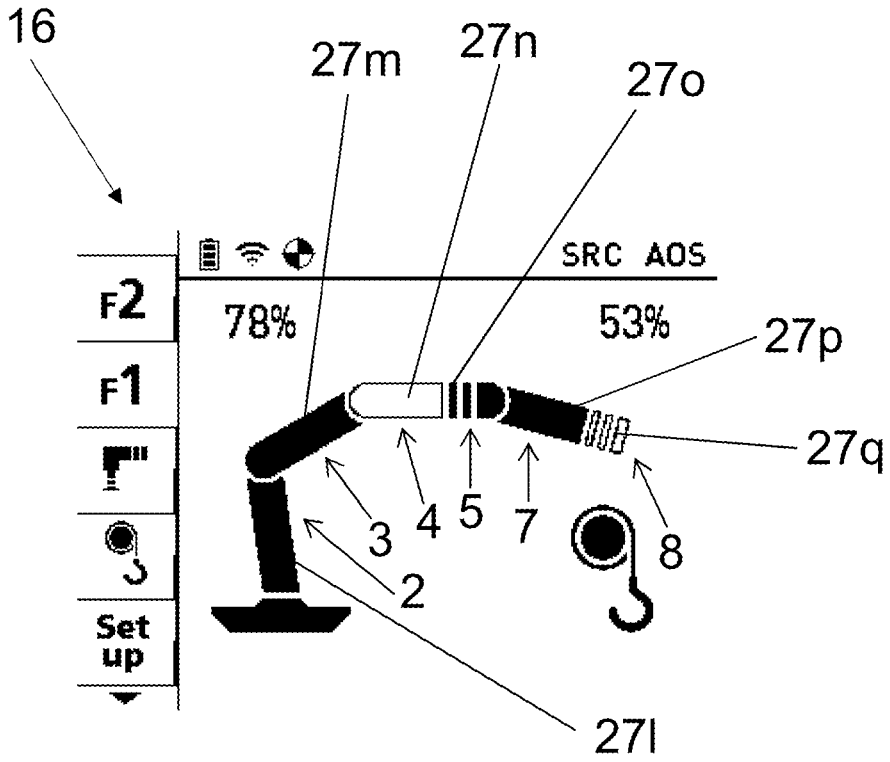
Figure 10D:
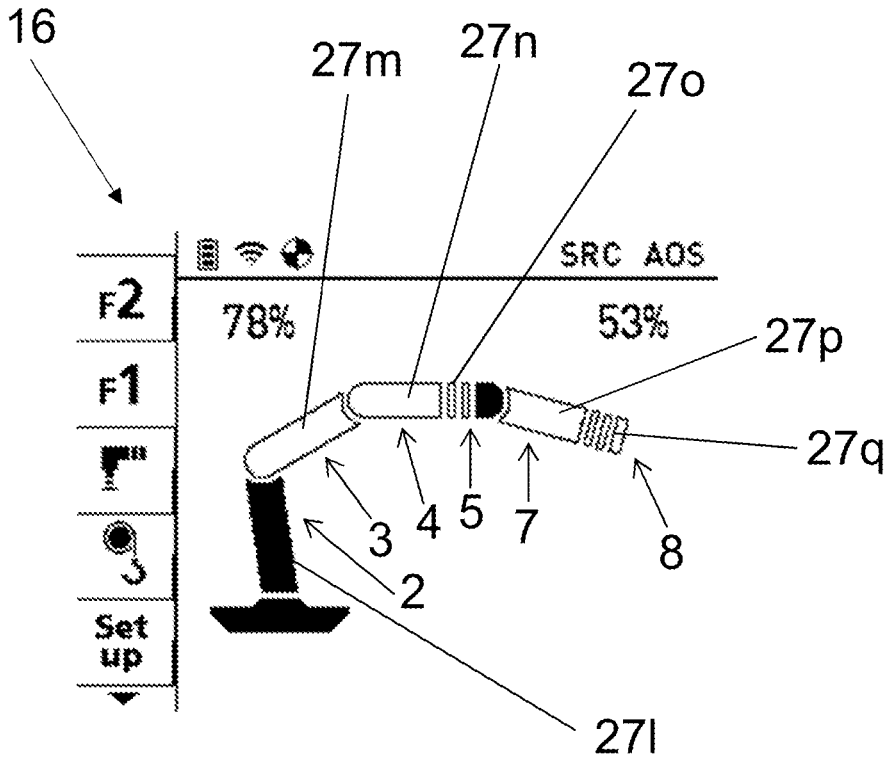
Figure 10E:
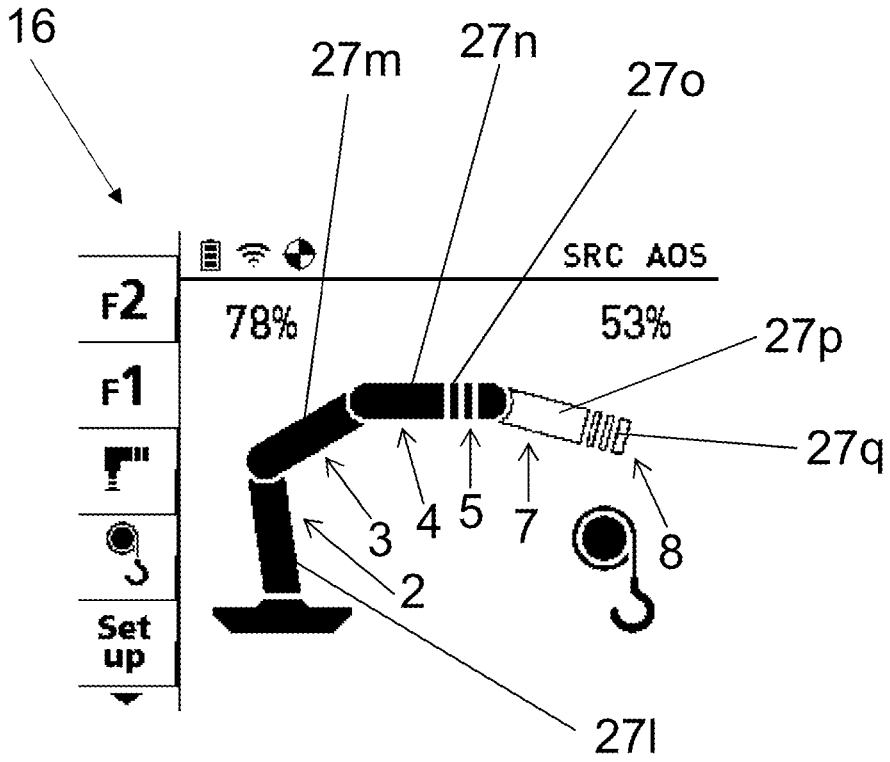

FIGS. 9*a* to 9*c* show possible application examples which make use of operating profiles.

In the example of FIG. 9*a*, for the degree of freedom α of the pivoting movement of the main arm 3, a target angle α0 is set which is located in an angle range which is optimized in terms of utilization and range (e.g. 20°), for example by a corresponding function of the user interface having been selected for setting the target angle α0 of the degree of freedom α of the pivoting movement of the main arm 3.

Thus, the crane 1 substantially achieves the maximum lifting force and the maximum range. If possible, an arm selection which comprises articulated arm 4 and extension arm 5 is always proceeded with in this application example.

In the example of FIG. 9*b*, in relation to the articulated arm 4, it is established that the articulated arm 4 always stops at a settable value $W_K$ before 180° to prevent a complete extension (180°) thereof, for example by a corresponding function of the user interface having been selected for restricting the degree of freedom β of the pivoting movement of the articulated arm 4 to a partial range β1-β4<β2 (cf. also FIG. 3*b* regarding this; β4=180°−$W_K$). Such a configuration is ideal for transporting bulky loads. If possible, an arm selection which comprises main arm 3 and extension arm 5 is always proceeded with in a prioritized manner in this application example.

In the example of FIG. 9*c*, the main arm 3 is held in its target position (e.g. >60°) for as long as possible. This amounts to an at least temporary limitation of the degree of freedom α of the pivoting movement of the main arm 3 to a partial range α3-α2 (see also FIG. 3*a* regarding this). If the main arm 3 departs from its target position downwards (in the direction 0°), it is always positioned back at its target angle again, if or as soon as the movement allows it. A permanent lowering of the main arm 3 during working in the steep position can thus be prevented. This reset function of the main arm 3 can be achieved for example using the arm selections of the operating profile according to Table 4, in which the arm selection with the prioritization 1 (articulated arm 4 and extension arm 5) is always proceeded with if possible. The crane 1 is moved for example in a coordinate-controlled manner using the arm selections of the operating profile according to Table 4 and, in the course of the movement of the arm system, the main arm 3 departs from its target position and is at an angular position of 50°. Subsequently, owing to a limit of travel or a re-start of the movement, a change of the arm selection occurs. After that, the two arm selections which comprise the main arm 3 (thus the arm selection with the prioritization 2 and the arm selection with the prioritization 3) are evaluated by the crane controller 6 as to whether the target position of the main arm 3 can be arrived at again with the current user specification. Thereafter, the arm selection which moves the main arm 3 back into its target position the quickest is temporarily (dynamically) put in first place (or obtains the prioritization with the number 1). When the target position of the main arm 3 is reached, the arm selection temporarily put in first place is put back to its original position according to Table 4 (or obtains its original prioritization again).

FIGS. 10*a* to 10*e* show by way of example embodiments of user interfaces which are in each case formed by displays 16 of crane controllers 6, which can be formed as touch displays.

If the display 16 of the crane controller 6 is implemented as a touch display, then the user interface can be implemented directly via the touch display. For example, by touching a crane arm 2, 3, 4, 5, 7, 8, represented on the display 16 once, the corresponding degree of freedom can be limited. To visualize the limitation the color of the correspondingly limited crane arm 2, 3, 4, 5, 7, 8 can change from white to black. If the crane arm 2, 3, 4, 5, 7, 8 is touched a further time, the limitation can be nullified again and the representation of the crane arm 2, 3, 4, 5, 7, 8 changes from black to white. An embodiment of the user interface as represented in FIGS. 10*a* to 10*e* is advantageous in particular in the case of an embodiment of the user interface via the touch display.

If this display 16 is not implemented as a touch display or the like, the menu-driven user interface can be navigated via an operating element. In such an embodiment of the user interface, an embodiment as shown in FIGS. 8*a* to 8*c* is advantageous. In such a case, an embodiment as represented in FIGS. 10*a* to 10*e* can for example act as a type of status display for the user, who can thus recognize at a glance which crane arms 2, 3, 4, 5, 7, 8 or degrees of freedom are limited.

The represented functions 27*l*, 27*m*, 27*n*, 27*o*, 27*p*, 27*q* of the crane controller 6 that can be chosen by a user, in the coordinate control operating mode, serve in each case for selecting an arm of the arm system of the crane 1 the degree of freedom of which is to be limited by being set to a predefined or predefinable value (or partial range). In other words, through the functions 27*l*, 27*m*, 27*n*, 27*o*, 27*p*, 27*q* that can be chosen by a user, it is possible to select which arms of the arm system are to be blocked, wherein the blocked arms no longer participate in the coordinate-controlled movement of the arm system and, instead, remain in their blocked position. Regarding this, an arm system of a crane 1, which comprises a crane column 2, a main arm 3, an articulated arm 4 and an extension arm 5, similarly to the embodiment of FIGS. 1*a* and 2*a*, is illustrated in each case graphically on the displays 16 of FIGS. 10*a* and 10*b*. The arm systems of the cranes 1 represented on the displays 16 of FIGS. 10*c* to 10*e* additionally comprise a second articulated arm 7 and a second extension arm 8. The arms blocked in each case via the functions 27*l*, 27*m*, 27*n*, 27*o*, 27*p*, 27*q* that can be chosen by a user are represented in each case in black in the illustrations of the arm systems.

Figure 11A:
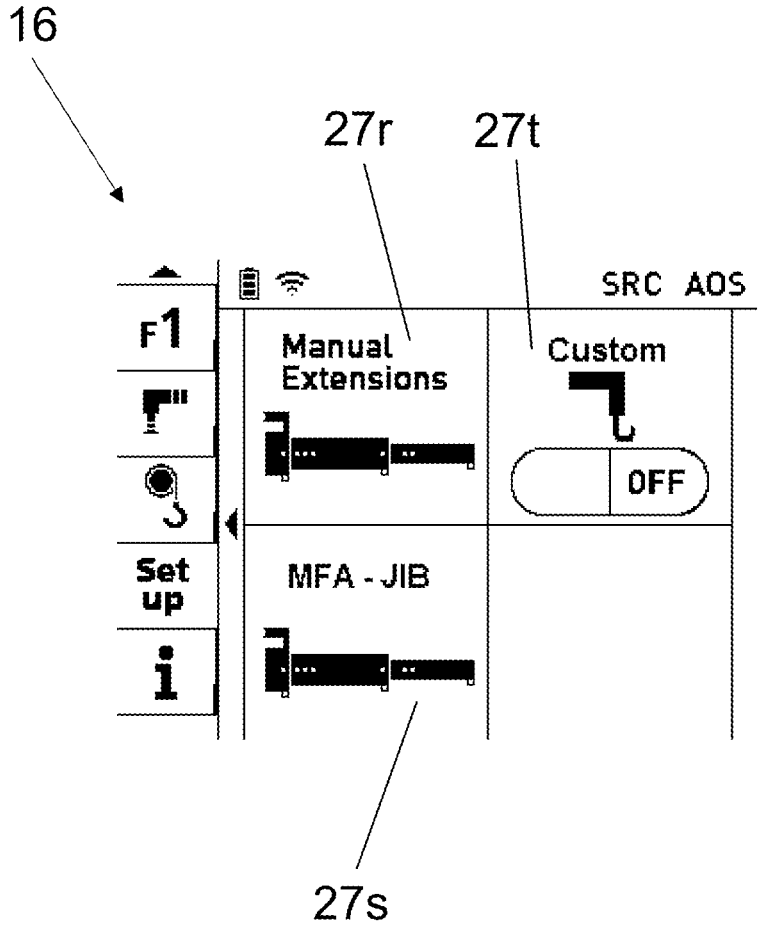
Figure 11B:
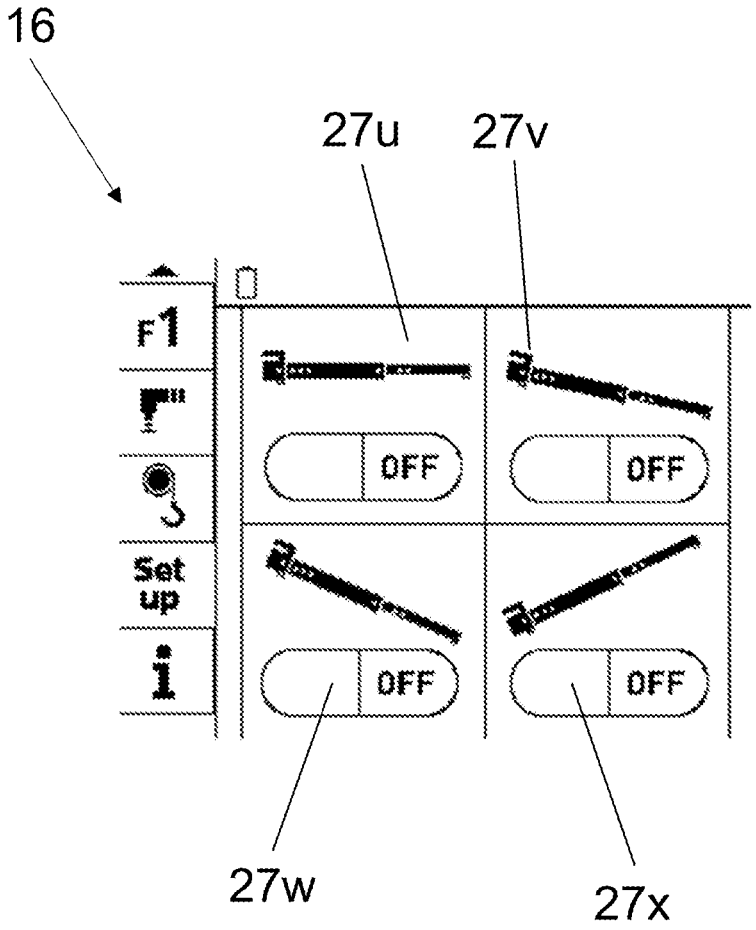
Figure 11C:
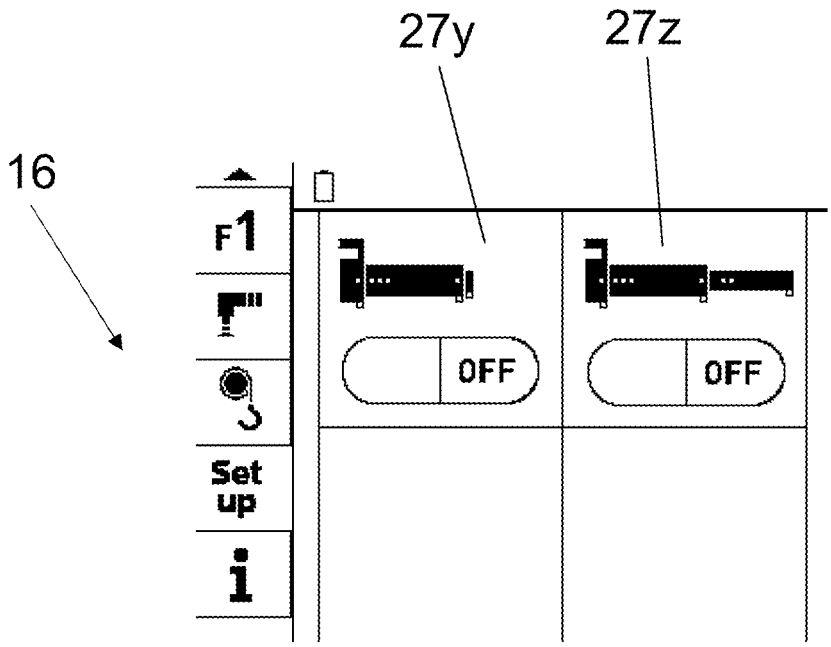

FIGS. 11*a* to 11*c* show by way of example embodiments of user interfaces which are formed in each case by displays 16 of crane controllers 6, which can be formed as touch displays. The functions 27*r*, 27*s*, 27*t*, 27*u*, 27*v*, 27*w*, 27*x*, 27*y*, 27*z* represented here that can be chosen by a user serve in each case for inputting information about an additional device attached to the arm system of the crane 1. Via the functions 27*r* and 27*s* represented in FIG. 11*a* that can be chosen, for example a menu is reached via which information about an additional device in the form of an arm extension 10 or an implement 9 (see FIGS. 5*a* and 5*b*) can be selected from a database stored in the memory 11 of the crane controller 6. Via the function 27*t* represented in FIG. 11*a* that can be chosen, for example a setup screen can be reached via which information about additional devices not stored in the memory 11 of the crane controller 6 can be input. Via the functions 27*u*, 27*v*, 27*w*, 27*x* represented in FIG. 11*b* that can be chosen, an angular position (angle ϑ) of an additional device attached to the arm system in the form of an arm extension 10 (see FIG. 5*b*) can be selected or input. The functions 27*y*, 27*z* represented in FIG. 11*c* that can be chosen serve for selecting the setup state of an additional device attached to the arm system in the form for example of one or more manually actuatable push-out extensions.

Figure 11D:
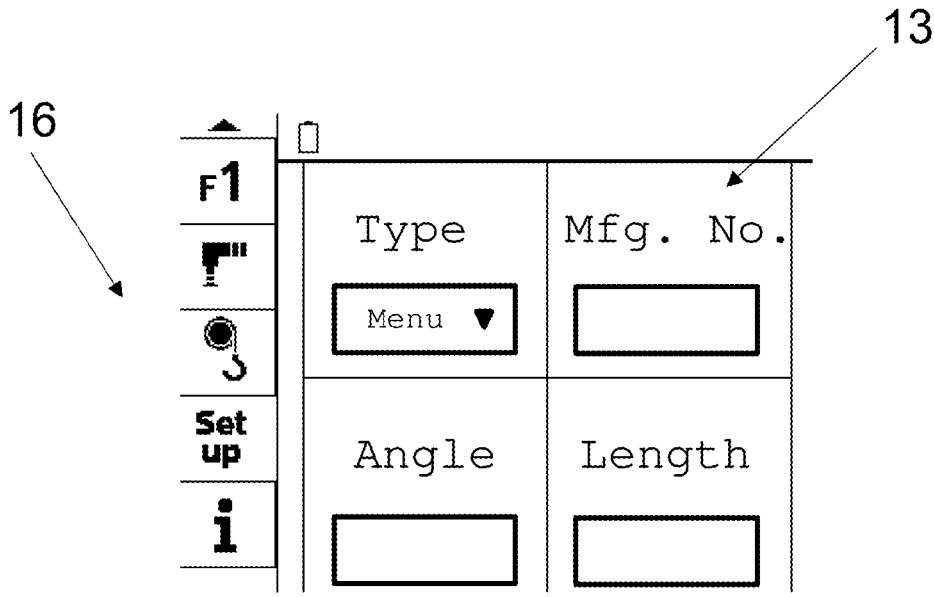

FIG. 11*d* shows an embodiment of an input screen 13, displayed on a display 16, via which information about the function range and/or dimension data and/or angular positions for the at least one additional device 9, 10 can be selected or input and can be transferred to the crane controller 6.

Figure 12:
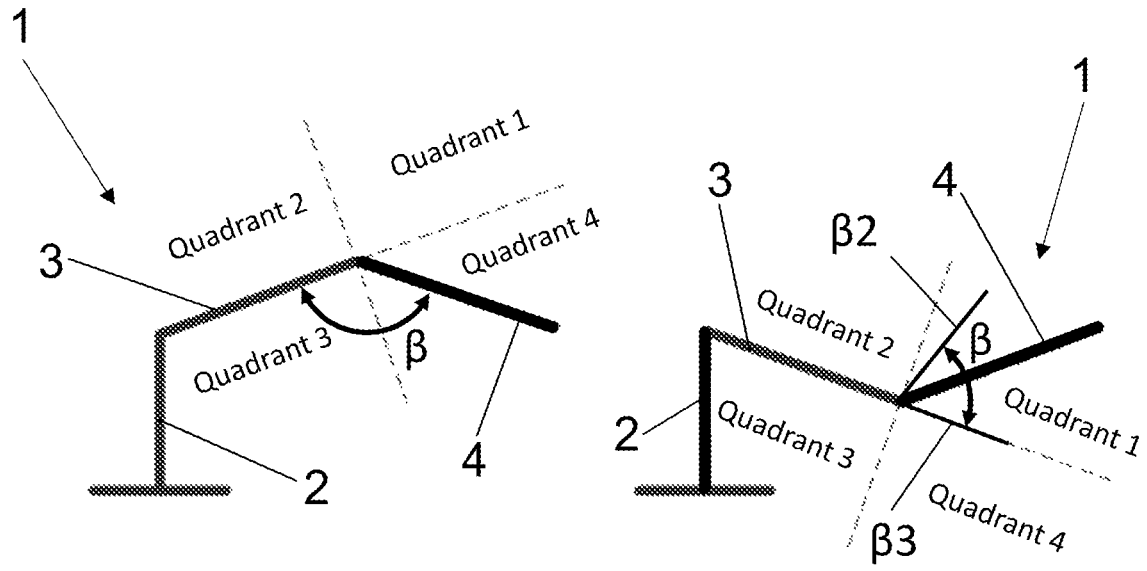

FIG. 12 shows by way of example the limitation of the degree of freedom β of the articulated arm 4 to a partial range β1<β3-β2, in order to make a so-called overextension of the articulated arm 4 possible, by the crane controller 6, in the coordinate control operating mode, providing an assistance function which can be selected via a function of the user interface that can be chosen by the user.

An imaginary extension of the main arm 3 (main arm line) and an imaginary line running perpendicularly thereto through the pivot bearing of the articulated arm 4 on the main arm 3 (pivot bearing line) form four regions or quadrants. Quadrant 1 denotes the region between the main arm line and the pivot bearing line above the main arm line and in the direction of the imaginary extension of the main arm 3. Quadrant 2 denotes the region between the main arm line and the pivot bearing line above the main arm line and in the direction of the main arm 3. Quadrant 3 denotes the region between the main arm line and the pivot bearing line underneath the main arm line and in the direction of the main arm 3. Quadrant 4 denotes the region between the main arm line and the pivot bearing line underneath the main arm line and in the direction of the imaginary extension of the main arm 3.

In the left-hand image, the articulated arm 4 is located in quadrant 4. When the articulated arm 4 approaches the dead center (the articulated arm angle is 180°, i.e. the articulated arm 4 is arranged in an exactly straight extension relative to the main arm 3) starting from quadrant 4, the articulated arm 4 is moved into the quadrant 1 and the degree of freedom β of the articulated arm 4 is restricted to quadrant 1 (see the right-hand image).

As soon as the articulated arm 4 is located in quadrant 1, it will move only in this quadrant, in order to keep the calculation in the coordinate control operating mode unambiguous.

Figure 13A:
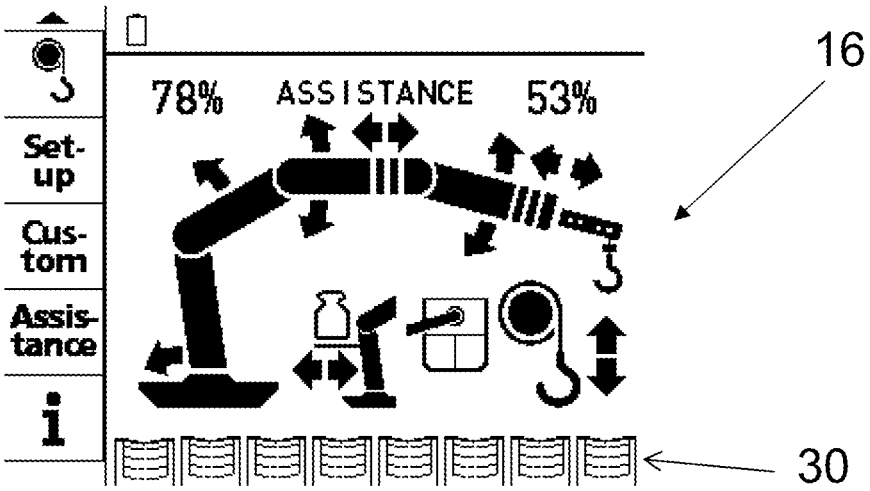

FIG. 13*a* shows the display 16 of a crane controller 6 of a proposed crane 1. The representation on the display 16 of the crane controller 6 can correspond to a representation in the operating mode, in which a free control of the arm system of the crane 1 on the basis of control commands input by the user is possible. The representation shown in FIG. 13*a* contains graphic representations of several linear levers 30 for the visualization of the function assignments that apply in this operating mode.

Figure 13B:
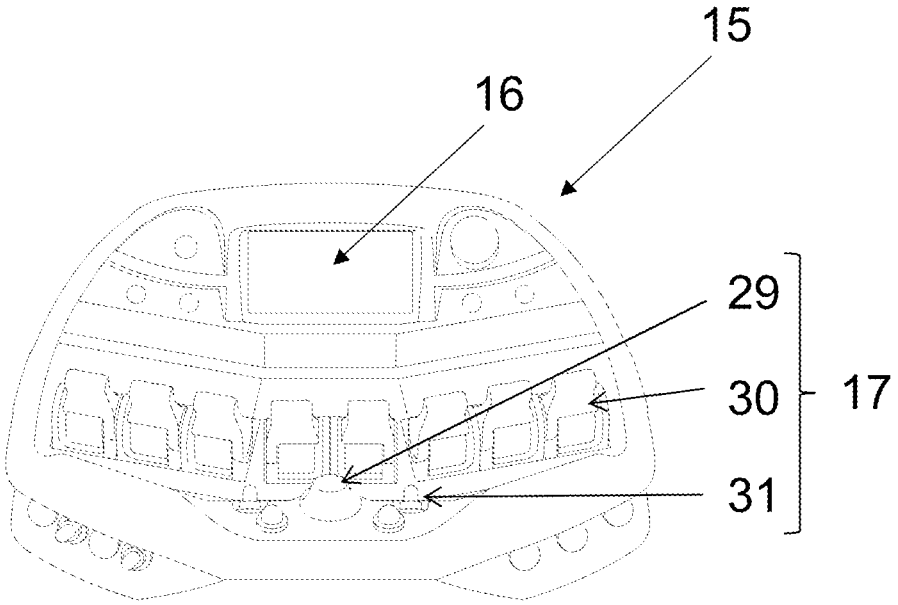

FIG. 13*b* shows an embodiment of a control panel 15 of the crane controller 6. In the embodiment represented, the control panel 15 has at least one display 16 and operating elements 17 in the form of a knob 29, a linear lever 30 and a push button 31. The operating elements can serve for navigating the menu-supported user interface, for selecting the function that can be chosen by a user or for issuing control commands by a user.

In an embodiment of the control panel 15 according to the embodiment of the crane controller 6 according to FIG. 13*a*, the control panel 15 can have a predefined operating element 17 for example in the form of a push button 31 configured as a dead man's switch. If the crane controller 6 is in the coordinate control operating mode, it is possible to switch to the further operating mode by actuation of the operating element 17 in the form of the push button 31 configured in such a way. This switch to the further operating mode lasts as long as the operating element 17 in the form for example of the push button 31 remains actuated by the user.

The display 16 represented in FIG. 13*a* can for example be displayed if, in the coordinate control operating mode, the above-described dead man's switch is pressed, wherein the crane controller switches to the further—freely controllable—operating mode. This has been made apparent to the operator with reference to the representation on the display 16. This can be effected independently of the embodiment variant of the display 16 (whether touch display or not).

FIG. 14 shows a display 16 with a safety query represented thereon, which is to be confirmed for example by a user, if the latter switches to the coordinate control operating mode. As represented in FIG. 7, this safety query can be effected when the operating mode function 26*c* is selected for changing to the coordinate control operating mode.

LIST OF REFERENCE NUMBERS

1 crane
2 crane column
3 main arm
4 articulated arm
5 extension arm
6 crane controller
7 second articulated arm
8 second extension arm
9 implement
10 arm extension
11 memory
12 processor
13 setup screen
14 crane tip
15 control panel
16 display
17 operating element
18 main arm extension arm
19 vehicle
20 slewing gear
21 main cylinder
22, 23, 25 articulated cylinder
24 further articulated arm
26*a*-26*d* operating mode functions that can be chosen
27*a*-27*z* functions that can be chosen
28 connecting region
29 knob
30 linear lever
31 push button
V1, h1, h2, h3 axes
α, β, φ, γ, L, J, H arm system degrees of freedom
$\varphi_0$, $\varphi_1$, $\varphi_2$, $\varphi_3$, $\varphi_4$ crane column pivoting angles
$\alpha_0$, $\alpha_1$, $\alpha_2$, $\alpha_3$, $\alpha_4$ main arm pivoting angles
$\beta_0$, $\beta_1$, $\beta_2$, $\beta_3$, $\beta_4$ articulated arm pivoting angles
$\gamma_0$, $\gamma_1$, $\gamma_2$, $\gamma_3$, $\gamma_4$ second articulated arm pivoting angles
$L_0$, $L_1$, $L_2$, $L_3$, $L_4$ extension arm extension positions
$J_0$, $J_1$, $J_2$, $J_3$, $J_4$ second extension arm extension positions
$H_0$, $H_1$, $H_2$, $H_3$, $H_4$ main arm extension arm extension positions
ϑ arm extension angle
a1, b1, g1, d1 angle
x1, x2 extension position
s1, s2 extension-position sensor
k1, k2, k3 articulation-angle sensor
f1 angle-of-rotation sensor

The invention claimed is:

1. A crane comprising:
a crane controller; and
an arm system,
wherein the arm system includes:

a crane column, rotatable about an axis of rotation, which is mounted so as to be pivotable over a structurally predefined crane column pivoting range and has one degree of freedom due to the pivotable mounting thereof;

a main arm, which is mounted on the crane column so as to be pivotable over a structurally predefined main arm pivoting range and has one degree of freedom due to the pivotable mounting thereof;

an articulated arm, which is mounted on the main arm so as to be pivotable over a structurally predefined articulated arm pivoting range and has one degree of freedom due to the pivotable mounting thereof; and an extension arm, which is mounted in the articulated arm so as to be displaceable over a structurally predefined extension range and has one degree of freedom due to the displaceable mounting thereof, wherein the crane controller is configured to carry out a coordinate control of the arm system in which at least one of the degrees of freedom of the arm system is limitable or limited via a selectable function of a user interface and individual actuators of the arm system are actuated by the crane controller via the user interface such that a behavior of a crane tip or a predefined or predefinable point of the arm system or a predefined or predefinable point supported by the arm system is controllable by a user.

2. The crane according to claim 1, wherein the articulated arm is a first articulated arm and the arm system further includes a second articulated arm, which is mounted on the extension arm so as to be pivotable over a structurally predefined second articulated arm pivoting range and has one degree of freedom due to the pivotable mounting thereof.

3. The crane according to claim 2, wherein the extension arm is a first extension arm and the arm system further includes a second extension arm, which is mounted in the second articulated arm so as to be displaceable over a structurally predefined second extension arm extension range and has one degree of freedom due to the displaceable mounting thereof.

4. The crane according to claim 1, wherein the arm system further includes at least one main arm extension arm, which is mounted in the main arm so as to be displaceable over a structurally predefined extension range and has one degree of freedom due to the displaceable mounting thereof.

5. The crane according to claim 1, wherein at least one additional device, which is an implement and/or a further arm extension, is arranged on the arm system.

6. The crane according to claim 5, wherein:

information for the at least one additional device can be transferred to the crane controller via the user interface; and the information for the at least one additional device can be selected from a database stored in a memory of the crane controller and/or can be input via the user interface.

7. The crane according to claim 1, wherein the at least one of the degrees of freedom of the arm system is limitable or limited via the selectable function of the user interface in order to nullify or reduce an overdetermination of the arm system.

8. The crane according to claim 7, wherein the one degree of freedom of the crane column is excluded from the limitable or limited degrees of freedom of the arm system to retain pivotability of the crane column.

9. The crane according to claim 7, wherein, through the selectable function of the user interface, all degrees of freedom of the arm system except for two degrees of freedom of the arm system are limitable or limited.

10. The crane according to claim 7, wherein:

the crane controller is configured to use an arm selection in a subset of the arms of the arm system to carry out the coordinate control of the arm system;

the crane controller has at least one operating profile, in which at least two arm selections are stored in a predefined or predefinable ranking from a higher prioritization to a lower prioritization or are determined continuously, and the crane controller is configured to use and actuate the at least two arm selections stored in the at least one operating profile according to prioritization for carrying out the coordinate control of the arm system; and the at least one operating profile can be selected through the selectable function of the user interface.

11. The crane according to claim 10, wherein the crane controller is configured to use an arm selection for the coordinate control of the arm system depending on a predefinable and/or a predefined and/or a prevailing position of the arm system.

12. The crane according to claim 10, wherein the crane controller is configured to use and actuate one of the at least two arm selections depending on an ability of the coordinate control of the arm system to be carried out with the one of the at least two arm selections.

13. The crane according to claim 1, wherein the at least one of the degrees of freedom of the arm system is:

settable or set to a predefined or predefinable value;

restrictable or restricted to a predefined or predefinable partial range; and/or restrictable or restricted in relation to a rate of change thereof.

14. The crane according to claim 13, wherein the one degree of freedom of the articulated arm is restrictable or restricted to the predefined or predefinable partial range such that the articulated arm is positionable or positioned in an overextended pivot position above an imaginary extension of the main arm.

15. The crane according to claim 13, wherein the predefined or predefinable partial range is smaller than or equal to 2°, or is smaller than or equal to 10 cm, and/or the rate of change is smaller than or equal to 0.2° per second, or is smaller than or equal to 2 cm per second.

16. The crane according to claim 1, wherein the crane controller has a control panel and the user interface is on the control panel.

17. The crane according to claim 1, wherein the user interface is menu-driven and/or includes at least one operating element of the crane controller.

18. The crane according to claim 1, wherein the user interface includes at least one operating element of the crane controller and the selectable function of the user interface can be chosen through an actuation of the at least one operating element by the user.

19. The crane according to claim 18, wherein:

the crane controller is configured to carry out a free control of the arm system;

a free actuation of the arm system is effected through the at least one operating element;

the at least one operating element includes a plurality of operating elements provided for respective arms of the arm system for input of control commands for moving one of the arms along one degree of freedom; and the one degree of freedom of the arm system assigned to each operating element is limitable or limited through an actuation of the operating element by the user.

20. The crane according to claim 1, wherein:

the crane controller is configured, in a free control operating mode, to carry out a free control of the arm system based on control commands input by the user; and starting from a coordinate control operating mode, a switch to the free control operating mode is effected for as long as a predefinable or predefined operating element of the crane controller remains actuated by the user.

21. A vehicle comprising the crane according to claim 1.

* * * * *